US009375726B2

(12) United States Patent
Johns

(10) Patent No.: US 9,375,726 B2
(45) Date of Patent: Jun. 28, 2016

(54) APPARATUS INCLUDING PLACER-GOLD PROCESSING SYSTEM AND METHOD THEREFOR

(71) Applicant: Brent Johns, Crawford Bay (CA)

(72) Inventor: Brent Johns, Crawford Bay (CA)

( * ) Notice: Subject to any disclaimer, the term of this patent is extended or adjusted under 35 U.S.C. 154(b) by 46 days.

(21) Appl. No.: 14/322,549

(22) Filed: Jul. 2, 2014

(65) Prior Publication Data

US 2016/0001299 A1 Jan. 7, 2016

(51) Int. Cl.

| | |
|---|---|
| ***B03C 1/30*** | (2006.01) |
| ***B03C 1/12*** | (2006.01) |
| ***B03C 1/033*** | (2006.01) |

(52) U.S. Cl.

CPC ..... *B03C 1/12* (2013.01); *B03C 1/0332* (2013.01); *B03C 2201/18* (2013.01); *B03C 2201/20* (2013.01)

(58) Field of Classification Search

CPC .. B03C 2201/18; B03C 2201/20; B03B 5/06; B03B 5/24; C22B 11/10

USPC ..... 209/39, 44, 201, 202, 458

See application file for complete search history.

(56) References Cited

U.S. PATENT DOCUMENTS

| | | | | |
|---|---|---|---|---|
| 432,823 | A | | 7/1890 | Finney |
| 644,944 | A | | 3/1900 | Milan |
| 775,043 | A | | 11/1904 | Lovett |
| 1,224,281 | A | | 5/1917 | Custer |
| 1,558,993 | A | * | 10/1925 | McLaughlin ..... C22B 11/00 209/14 |
| 2,083,674 | A | | 6/1937 | Smith |
| 4,347,130 | A | | 8/1982 | Younge |
| 4,525,270 | A | | 6/1985 | Mccann |
| 4,717,469 | A | | 1/1988 | Pirc |
| 4,860,874 | A | | 8/1989 | Winderl |
| 4,962,858 | A | | 10/1990 | Newman et al. |
| 5,170,891 | A | | 12/1992 | Barrett |
| 5,273,162 | A | | 12/1993 | Riherd |
| 5,927,508 | A | | 7/1999 | Plath |
| 6,308,835 | B1 | | 10/2001 | Wade |
| 8,399,790 | B1 | | 3/2013 | Slade |
| 2013/0001138 | A1 | | 1/2013 | Enfantino |

FOREIGN PATENT DOCUMENTS

| | | |
|---|---|---|
| CA | 398977 | 9/1941 |
| CA | 1110206 | 10/1981 |
| CA | 1197218 | 11/1985 |
| CA | 1251765 | 3/1989 |
| CA | 2015897 | 1/1991 |
| CA | 2755224 | 10/2009 |
| CA | 2429170 | 11/2009 |
| GB | 282298 | 12/1927 |

* cited by examiner

*Primary Examiner* — Joseph C Rodriguez
*Assistant Examiner* — Kalyanavenkateshware Kumar
(74) *Attorney, Agent, or Firm* — Giuseppe Mariconda

(57) ABSTRACT

An apparatus includes a placer-gold processing system, including: (A) an upstream section; (B) a gold-concentrator assembly being configured to be in fluid communication with the upstream section; (C) a gold-detection assembly being configured to be in fluid communication with the gold-concentrator assembly; and (D) a magnetite-separator assembly being configured to be in fluid communication with the gold-concentrator assembly.

14 Claims, 23 Drawing Sheets

APPARATUS INCLUDING PLACER-GOLD PROCESSING SYSTEM AND METHOD THEREFOR

TECHNICAL FIELD

Some aspects generally relate to (and are not limited to) an apparatus including a placer-gold processing system (and method therefor). More specifically, some aspects provide a placer-gold processing system including: a gold-concentrator assembly, a gold-detection assembly, and a magnetite-separator assembly (and methods therefor).

SUMMARY

Placer mining is the technique by which placer gold that has accumulated in a placer deposit is extracted. Placer deposits are composed of relatively loose material that makes tunneling difficult, and so most means of extracting the placer gold involve the usage of water or dredging. Placer mining is a process for separating placer gold from sand, gravel, etc. For instance, a sluice box, used to extract gold from placer deposits, has long been a very common practice in prospecting and small-scale mining. A sluice box provides a channel with riffles set in the bottom. The riffles are designed to create dead zones in the current to allow gold to drop out of suspension. The box is placed in the stream to channel water flow. Gold-bearing material is placed at the top of the box. The material is carried by the current through the volt where gold and other dense material settles out behind the riffles. Less dense material flows out of the box as tailings.

In view of the foregoing, it will be appreciated that there exists a need to mitigate (at least in part) problems associated with detection of an anomaly associated with a network. After much study of the known systems and methods along with experimentation, an understanding of the problem and its solution has been identified and is articulated below.

The problem with existing placer-gold processing systems is that these systems are not configured to assist a prospector to identify or locate a payload of placer gold in an efficient manner; much time may be wasted in the search for placer gold, until a payload is found by the prospector. What is needed is a system that avoids continued prospecting of unproductive sites (thereby saving time). Other types of problems are also mitigated, at least in part, by the aspects as identified below (explicitly or implicitly).

In order to mitigate, at least in part, the problem(s) identified with existing placer-gold processing systems and/or methods associated with placer-gold processing systems, there is provided (in accordance with an aspect) an apparatus including a placer-gold processing system, including: (A) an upstream section; (B) a gold-concentrator assembly being configured to be in fluid communication with the upstream section; (C) a gold-detection assembly being configured to be in fluid communication with the gold-concentrator assembly; and (D) a magnetite-separator assembly being configured to be in fluid communication with the gold-concentrator assembly.

In order to mitigate, at least in part, the problem(s) identified with existing placer-gold processing systems and/or methods associated with placer-gold processing systems, there is provided (in accordance with an aspect) an apparatus including a placer-gold processing system, including: (A) an upstream section; and (B) a gold-concentrator assembly being configured to: (a) receive, at least in part, flowing water and placer gold from the upstream section of the placer-gold processing system; and (b) divert, at least in part, the placer gold and the flowing water that was received from the upstream section away from a waste output region and toward a diverter output region in such a way that at least more of the placer gold travels through the diverter output region than through the waste output region.

In order to mitigate, at least in part, the problem(s) identified with existing placer-gold processing systems and/or methods associated with placer-gold processing systems, there is provided (in accordance with an aspect) an apparatus including a placer-gold processing system, including: (A) an upstream section; and (B) a gold-detection assembly being configured to: (a) contact, at least in part, placer gold being conveyed by flowing water received, at least in part, from the upstream section of the placer-gold processing system; (b) retard, at least in part, the motion of the placer gold relative to the flowing water as the flowing water moves through the gold-detection assembly; and (c) visually display, at least in part, the placer gold being retarded from motion relative to the flowing water as the flowing water moves through the gold-detection assembly.

In order to mitigate, at least in part, the problem(s) identified with existing placer-gold processing systems and/or methods associated with placer-gold processing systems, there is provided (in accordance with an aspect) an apparatus including a placer-gold processing system, including: (A) an upstream section; and (B) a magnetite-separator assembly being configured to: (a) receive, at least in part, the flowing water and the magnetite particles received, at least in part, from the upstream section of the placer-gold processing system; and (b) divert, at least in part, the magnetite particles that are received toward a magnetite output area. Advantages provided in accordance with an example or an aspect of the magnetite-separator assembly is that (if desired) there are no motors and/or gears, and therefore there are fewer breakdowns; as well, the magnetite-separator assembly may be lightweight, which makes the magnetite-separator assembly portable; by removing magnetite the magnetite-separator assembly improves (at least in part) fine gold recovery.

In order to mitigate, at least in part, the problem(s) identified with existing placer-gold processing systems and/or methods associated with placer-gold processing systems, there is provided (in accordance with an aspect) a method of concentrating placer gold in an apparatus having a placer-gold processing system, the method comprising: (A) receiving, at least in part, flowing water and the placer gold from an upstream section of the placer-gold processing system; and (B) diverting, at least in part, the placer gold and the flowing water that was received from the upstream section away from a waste output region and toward a diverter output region in such a way that at least more of the placer gold travels through the diverter output region than through the waste output region.

In order to mitigate, at least in part, the problem(s) identified with existing placer-gold processing systems and/or methods associated with placer-gold processing systems, there is provided (in accordance with an aspect) a method of detecting placer gold in an apparatus having a placer-gold processing system, the method comprising: (A) contacting, at least in part, the placer gold being conveyed by flowing water received, at least in part, from an upstream section of the placer-gold processing system; (B) retarding, at least in part, the motion of the placer gold relative to the flowing water as the flowing water moves through the gold-detection assembly; and (C) visually displaying, at least in part, the placer gold being retarded from motion relative to the flowing water as the flowing water moves through the gold-detection assembly.

In order to mitigate, at least in part, the problem(s) identified with existing placer-gold processing systems and/or methods associated with placer-gold processing systems, there is provided (in accordance with an aspect) a method of separating magnetite in an apparatus having a placer-gold processing system, the method comprising: (A) receiving, at least in part, flowing water and the magnetite particles received, at least in part, from an upstream section of the placer-gold processing system; and (B) diverting, at least in part, the magnetite particles that are received toward a magnetite output area.

In order to mitigate, at least in part, the problem(s) identified above, in accordance with an aspect, there is provided other aspects as identified in the claims.

Other aspects and features of the non-limiting embodiments may now become apparent to those skilled in the art upon review of the following detailed description of the non-limiting embodiments with the accompanying drawings.

DETAILED DESCRIPTION OF THE DRAWINGS

The non-limiting embodiments may be more fully appreciated by reference to the following detailed description of the non-limiting embodiments when taken in conjunction with the accompanying drawings, in which.

Figure 1:
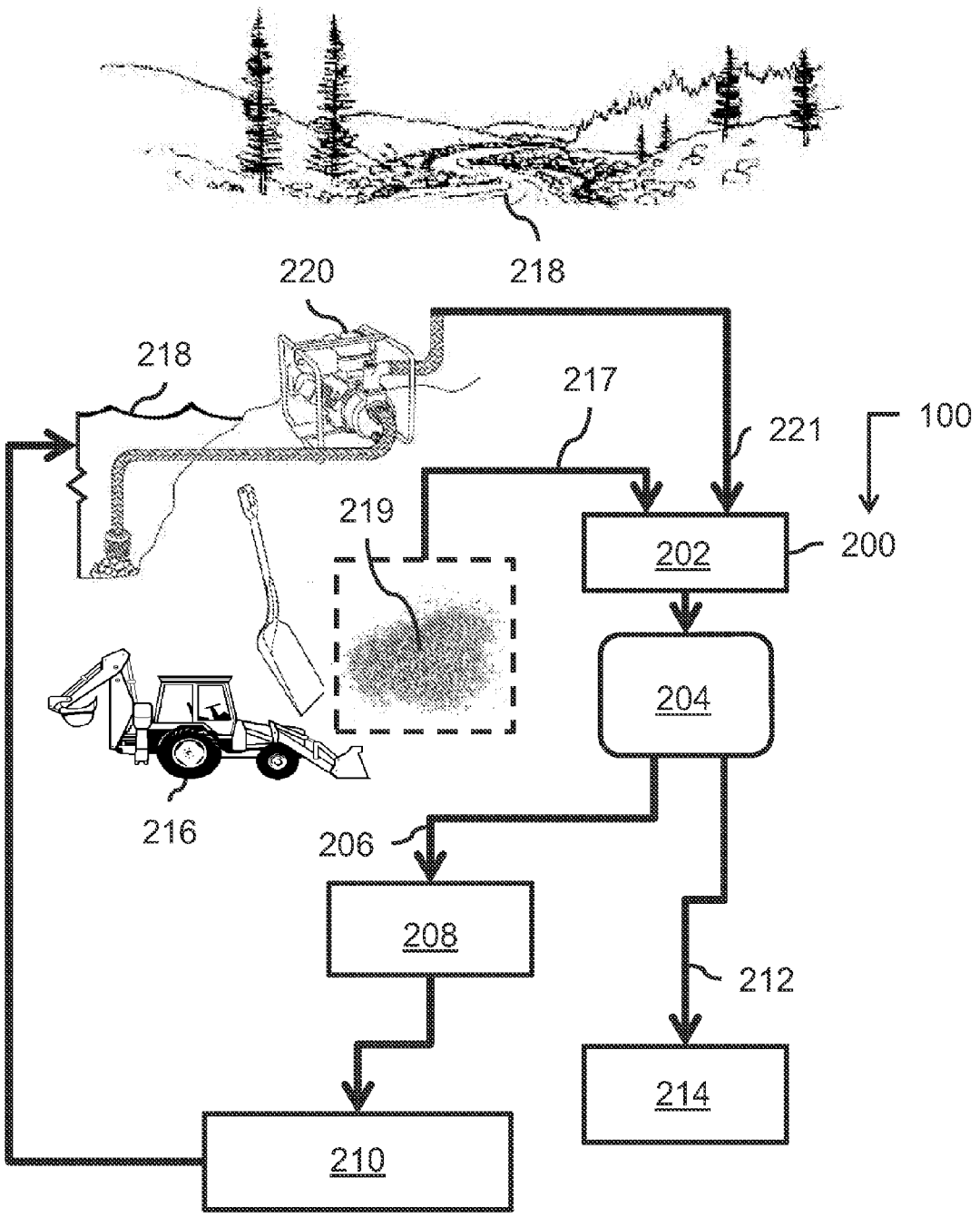
FIG. 1 (SHEET 1/23) depicts a schematic representation of an example of an apparatus having a placer-gold processing system.
Figure 4A:
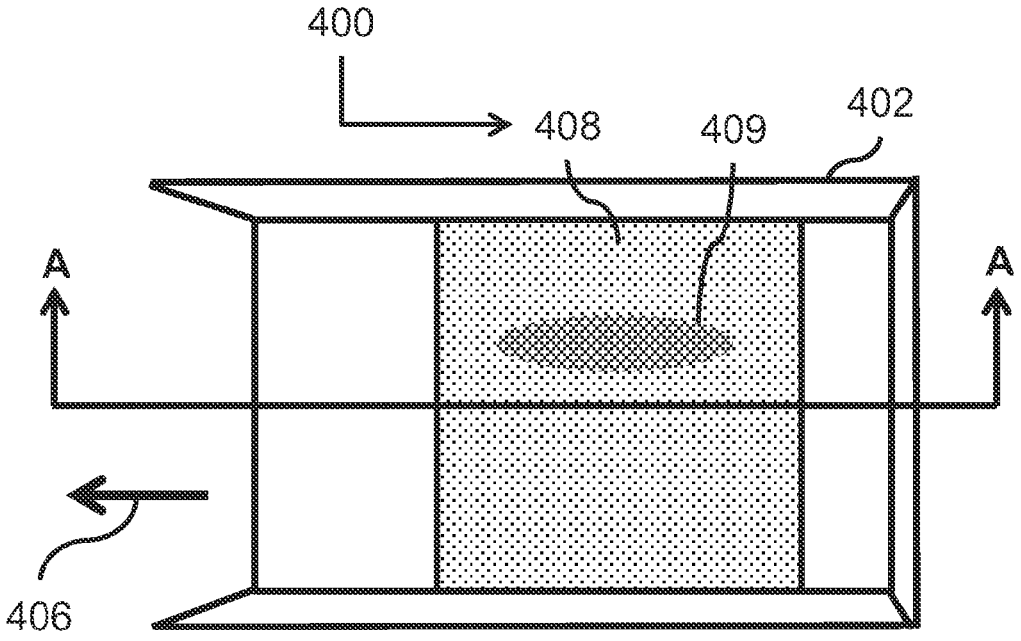
Figure 4B:
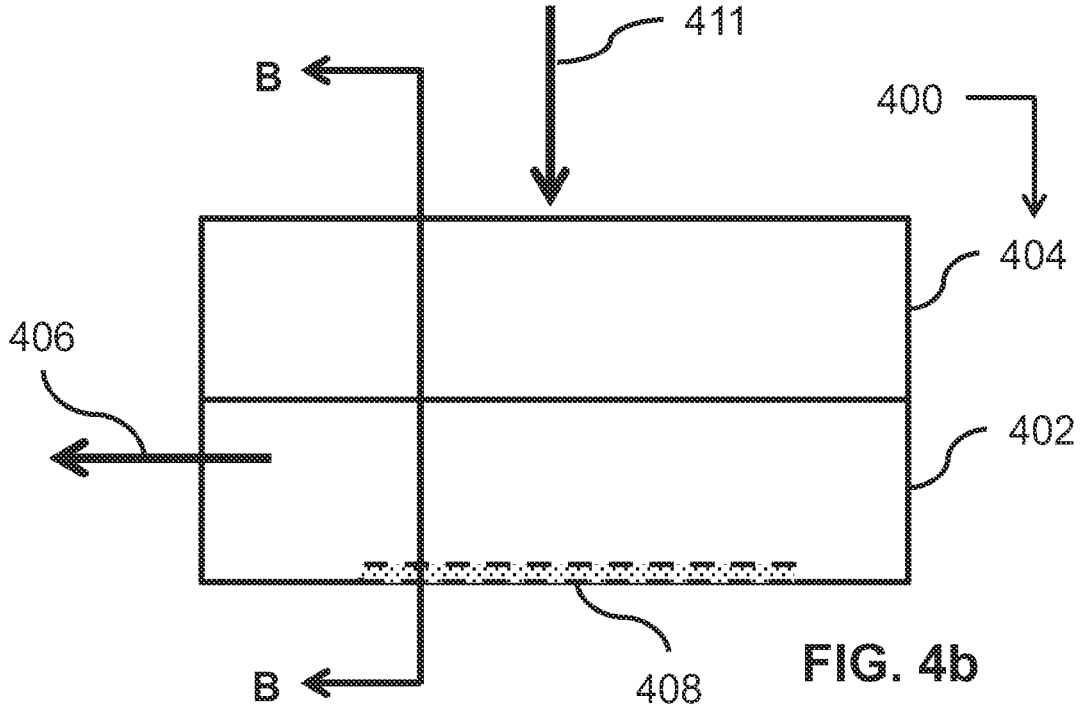
Figure 4C:
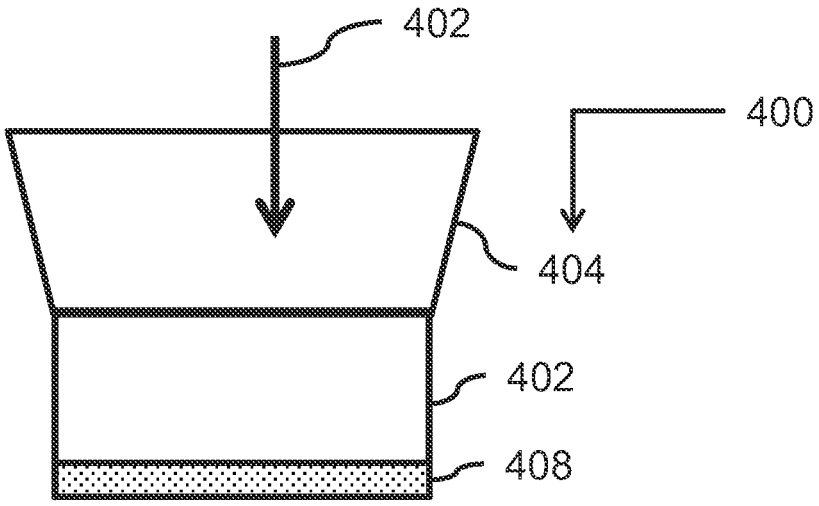
Figure 5A:
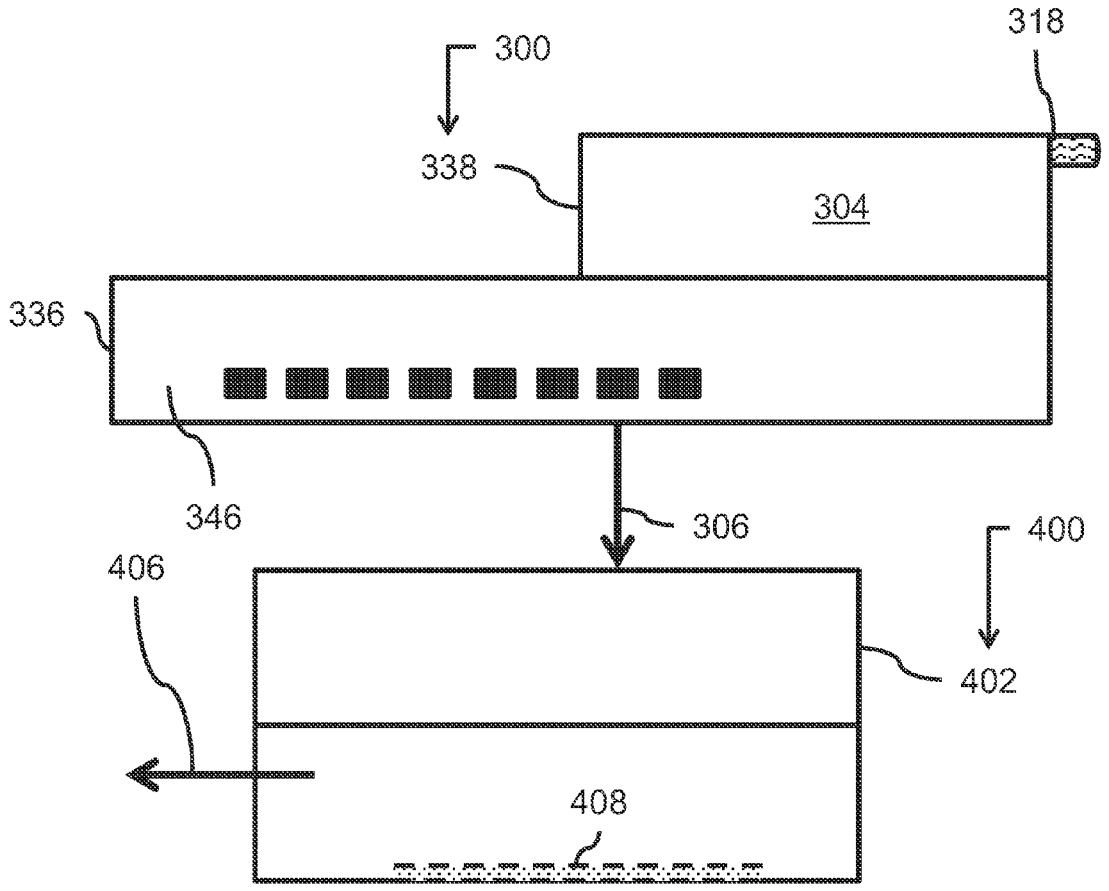
Figure 5B:
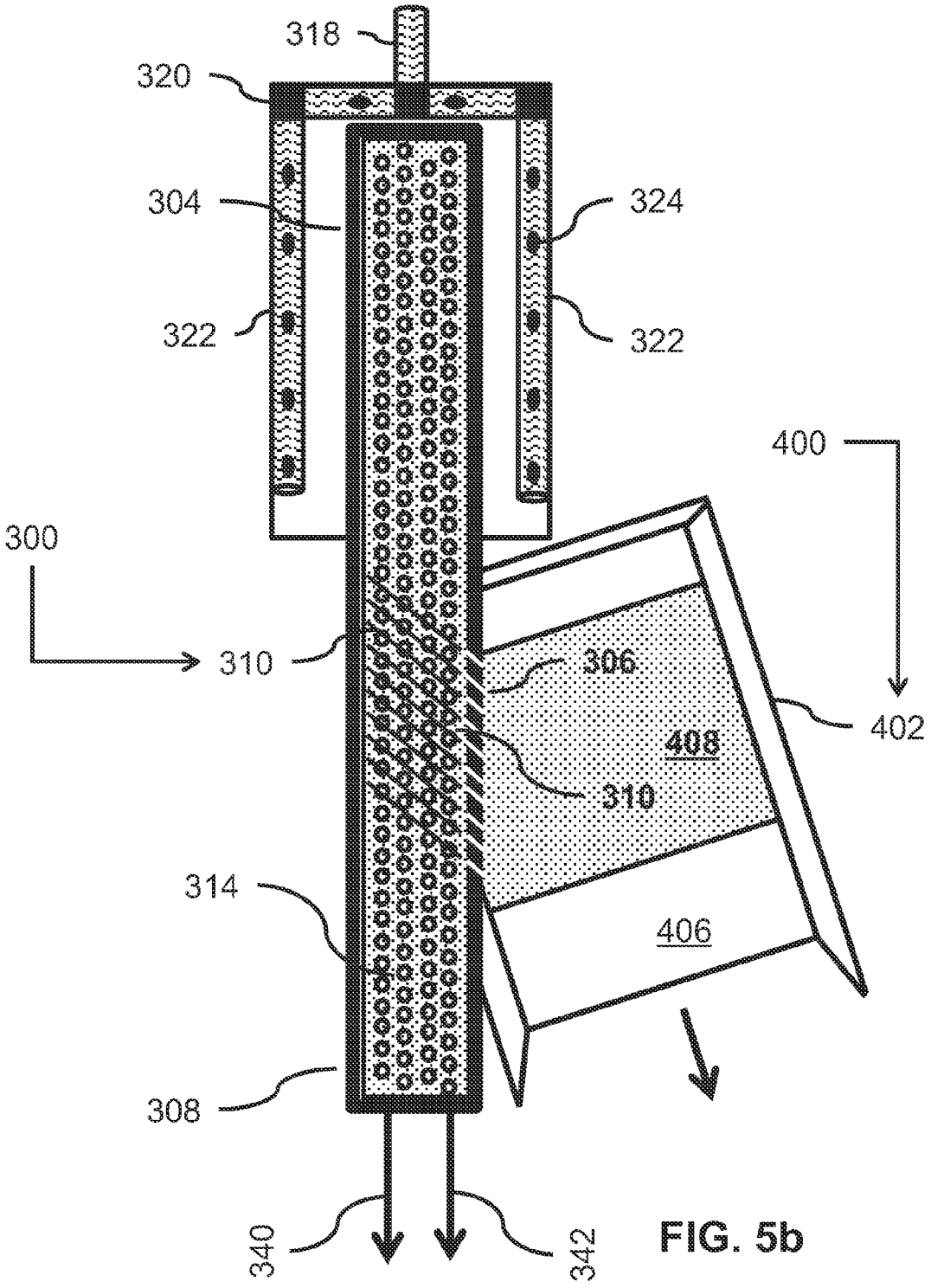

FIGS. 3*a* to 3*j* (SHEET 3/23 to SHEET 9/23) depict views of examples of the apparatus of FIG. 1 having the placer-gold processing system including a gold-concentrator assembly;

FIGS. 4*a* to 4*c* (SHEET 10/23 to SHEET 11/23) depict views of examples of the apparatus of FIG. 1 having the placer-gold processing system including a gold-detection assembly:

FIGS. 5*a* and 5*b* (SHEET 12/23 to SHEET 13/23) depict views of examples of the apparatus of FIG. 1 having the placer-gold processing system including a gold-concentrator assembly and a gold-detection assembly;

FIGS. 6*a* to 6*e* (SHEET 14/23 to SHEET 15/23) depict views of examples of the apparatus of FIG. 1 having a placer-gold processing system including a magnetite-separator assembly; and FIGS. 7*a* to 7*m* (SHEET 16/23 to SHEET 23/23) depict schematic representations of examples of the apparatus of FIG. 1.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating an understanding of the various presently disclosed embodiments. In addition, common, but well-understood, elements that are useful or necessary in commercially feasible embodiments are often not depicted in order to facilitate a less obstructed view of the various embodiments of the present disclosure.

LISTING OF REFERENCE NUMERALS USED IN THE DRAWINGS

100 apparatus
200 placer-gold processing system
202 upstream section
204 grizzly filter section
206 gravel-bypass branch
208 gold-nugget trap
210 settling pond
212 next-stage branch
214 next stage
216 material handler
217 aggregate input
218 river
219 aggregate
220 pump
221 river-water input
246 side wall
300 gold-concentrator assembly
301 catcher
302 trough assembly
304 input region
306 diverter output region
308 waste output region
310 self-flushing riffle region
312 riffle body
314 punch plate
314*a* fine mesh portion
314*b* course mesh portion
316 water input
318 water input tubing
320 water connector
322 water tubing
324 spray nozzle
326 spray nozzle
328 aggregate input
330 riffle groove
332 riffle ledge
334 water flow direction
336 lower section
338 upper section
340 gravel output
342 bypass output
344 water flow
400 gold-detection assembly
401 indicator bypass branch
402 open container assembly
403 indicator feed branch
404 input section
405 slurry collection
406 output section
407 slurry collection
408 gold-indicator section
409 placer gold
411 input flow
500 magnetite-separator assembly
501 magnetite catcher
502 input area
503 collection
504 output area
505 collection
506 magnetite-attraction area
507 magnet
508 magnetite output area
510 paddle
512 disk

514 bearing
516 stationary shaft
518 magnetite
520 nozzle
522 sluice box
524 first direction
526 second direction
528 third direction
530 water spray
532 input flow direction
534 output flow direction
536 elongated trough
600 sluice assembly
601 collection
700 tray
702 water
704 field concentrate

DETAILED DESCRIPTION OF THE NON-LIMITING EMBODIMENT(S)

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of the description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments (examples), aspects and/or concepts defined in the appended claims. Hence, specific dimensions and other physical characteristics relating to the embodiments disclosed herein are not to be considered as limiting, unless the claims expressly state otherwise. It is understood that "at least one" is equivalent to "a". The aspects (examples, alterations, modifications, options, variations, embodiments and any equivalent thereof) are described with reference to the drawings. It should be understood that the invention is limited to the subject matter provided by the claims, and that the invention is not limited to the particular aspects depicted and described.

FIG. 1 depicts a schematic representation of an example of an apparatus 100 having a placer-gold processing system 200.

FIG. 1 depicts the following: an apparatus 100, a placer-gold processing system 200, an upstream section 202, a grizzly filter section 204 (known), a gravel-bypass branch 206, a gold-nugget trap 208 (known), a settling pond 210 (also called a water-detention zone, etc.), a next-stage branch 212, a next stage 214, a material handler 216, an aggregate input 217, a river 218, an aggregate 219 (a material pile), a pump 220, and a river-water input 221.

Referring to FIG. 1, the apparatus 100 includes the placer-gold processing system 200. The placer-gold processing system 200 includes (and is not limited to) the upstream section 202, the grizzly filter section 204 (generally known), a gold-nugget trap 208 (generally known), and the next stage 214 (to be further described or disclosed in connection with the remaining FIGS). The purpose of the placer-gold processing system 200 is to improve, at least in part, gold recovery from the environment (sands, river beds, etc.). Placer gold is defined as a surficial gold mineral deposit formed by the concentration of small particles of gold in gravel or small sands.

The upstream section 202 includes the river-water input 221, and also includes the aggregate input 217. The river-water input 221 is configured to be fluidly connected to the pump 220. The pump 220 is configured to pump (in use) the river water from the river 218 located in the wilderness (an outdoor setting) to the river-water input 221 in such a way that the river water is moved from the river 218 to the upstream section 202 (via the river-water input 221).

The aggregate input 217 is configured to receive the aggregate 219 found or positioned in or near the river 218 (either on shore or off shore). The material handler 216 (such as a backhoe and/or a shovel) is configured to move the aggregate 219 into the aggregate input 217 in such a way that the aggregate 219 enters the upstream section 202 (via the aggregate input 217).

The upstream section 202 is configured to mix (at least in part) the aggregate 219 with the river water in such a way that a slurry is formed in the upstream section 202. The mixing of the river water and the aggregate 219 may be performed by gravity feeding, etc. The slurry includes a mixture of the river water, the placer gold (gold particles and/or gold nuggets), gravel sand, magnetite, etc. The slurry formed in the upstream section 202 includes a course slurry component and a fine slurry component. The upstream section 202 is configured to fluidly connect with the grizzly filter section 204 in such a way that the slurry moves from the upstream section 202 to the grizzly filter section 204 (by way of gravity feed, etc.).

The grizzly filter section 204 includes a slurry input, a course slurry output and a fine slurry output. The slurry input of the grizzly filter section 204 is fluidly connected to the upstream section 202. The course slurry output of the grizzly filter section 204 is fluidly connected to the gold-nugget trap 208. The fine slurry output of the grizzly filter section 204 is fluidly connected to the next stage 214. The grizzly filter section 204 includes a gravel filter and/or a screen component; the grizzly filter section 204 is used to avoid inadvertent or unwanted plugging of the next stage 214 (in addition, classification helps gold recovery). The grizzly filter section 204 is configured to: (A) receive the slurry from the upstream section 202; (B) separate the slurry received from the upstream section 202 into the course slurry component and the fine slurry component; (C) provide the course slurry component to the gold-nugget trap 208 (via the gravel-bypass branch 206); and (D) provide the fine slurry component to the next stage 214 (via the next-stage branch 212). The gravel-bypass branch 206 fluidly connects the course slurry output of the grizzly filter section 204 to the gold-nugget trap 208. The next-stage branch 212 fluidly connects the fine slurry output of the grizzly filter section 204 to the next stage 214. The course slurry component flows (by way of gravity feed) from the course slurry output of the grizzly filter section 204 to the gold-nugget trap 208. The finer slurry component flows (by way of gravity feed) from the fine slurry output of the grizzly filter section 204 to the next stage 214.

The gravel-bypass branch 206 is configured to fluidly connect the grizzly filter section 204 with the gold-nugget trap 208. The next-stage branch 212 is configured to fluidly connect the grizzly filter section 204 with the next stage 214.

The gold-nugget trap 208 is configured to trap (remove, retain) gold nuggets from the course slurry component that was received from the grizzly filter section 204. The gold-nugget trap 208 is configured to fluidly connect with the settling pond 210 in such a way that the course slurry component may flow from the gold-nugget trap 208 to the settling pond 210 (by way of gravity feed, etc.)

Once the course slurry component is received by the settling pond 210, the course slurry component may settle out and any relatively clear water from the settling pond 210 may be returned to the river 218 by way of a pump system (or by gravity feed), etc.

Examples of the next stage 214 are depicted in the remaining FIGS.

Figure 2:
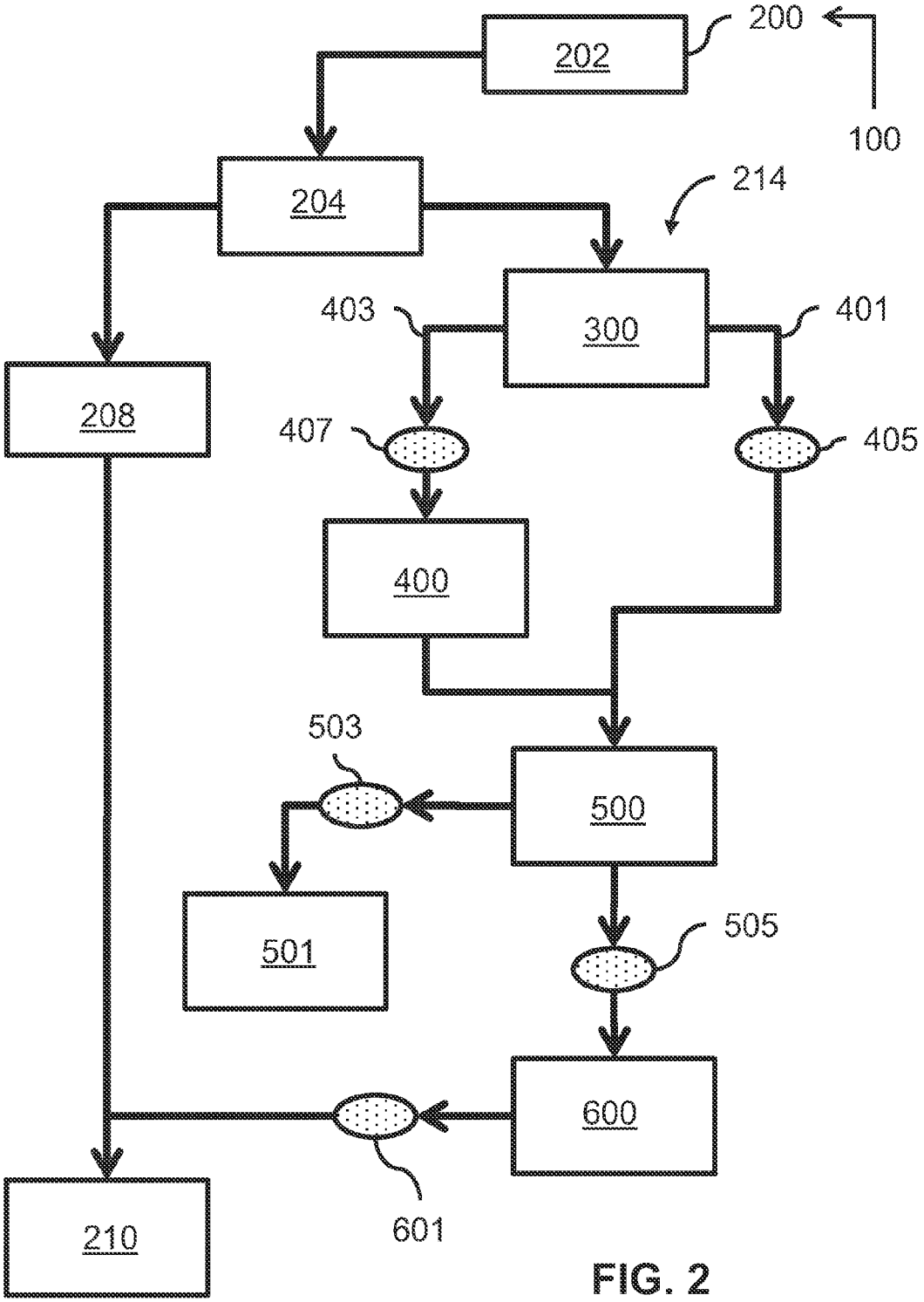
FIG. 2 (SHEET 2/23) depicts a schematic representation of an example of the apparatus of FIG. 1.

FIG. 2 depicts a schematic representation of an example of the apparatus 100 of FIG. 1.

FIG. 2 depicts the apparatus 100, the placer-gold processing system 200, the upstream section 202, the grizzly filter section 204, the gold-nugget trap 208, the settling pond 210, examples of the next stage 214, the gold-concentrator assembly 300, the gold-detection assembly 400, the indicator bypass branch 401, the slurry collection 405, the indicator feed branch 403, the slurry collection 407, the magnetite-separator assembly 500, the magnetite catcher 501, the collection 503, the collection 505, a sluice assembly 600, and the collection 601.

Examples of the next stage 214 include: the gold-concentrator assembly 300, the gold-detection assembly 400, the magnetite-separator assembly 500, and/or the sluice assembly 600.

The gold-concentrator assembly 300 is configured to be fluidly connected to the grizzly filter section 204 in such a way that the fine slurry component is received from the grizzly filter section 204. The gold-concentrator assembly 300 includes a slurry input, a gold-concentrate output and a bypass output. The slurry input of the gold-concentrator assembly 300 is configured to be fluidly connected to the grizzly filter section 204. The gold-concentrate output of the gold-concentrator assembly 300 is configured to be in fluid communication with the indicator feed branch 403. The bypass output of the gold-concentrator assembly 300 is configured to be in fluid communication with the indicator bypass branch 401. The gold-concentrator assembly 300 is configured to accumulate (concentrate), at least in part, the placer gold to be outputted via the gold-concentrate output of the gold-concentrator assembly 300. It will be appreciated that some of the placer gold may find its way into the bypass output of the gold-concentrator assembly 300.

The gold-detection assembly 400 includes the indicator bypass branch 401, and the indicator feed branch 403 (both are inputs to the gold-detection assembly 400). The gold-detection assembly 400 also includes an output branch configured to be in fluid communication with the magnetite-separator assembly 500. The gold-detection assembly 400 is configured to retain and display, at least in part, some of the placer gold moving along the indicator feed branch 403. The slurry collection 405 (a mixture of placer gold, river water, sand, magnetite, etc.) moves along the indicator bypass branch 401. The slurry collection 407 (a mixture of placer gold, river water, sand, magnetite, etc.) moves along the indicator feed branch 403. The purpose of the gold-detection assembly 400 is to permit the user of the apparatus 100 (such as a gold prospector) to visually ascertain whether they are inputting (via the upstream section 202) the aggregate that has a desirable payload of placer gold. For instance, the prospector may randomly decide to input aggregate from a site or may decide to change the site from which to input the aggregate, all the while the prospector monitors the gold-detection assembly 400 to obtain a visual indicator as to whether the aggregate from one site or another site provides the desirable amount of placer gold; the visual indicator provides relatively faster feedback for the prospector than for the case where the gold-detection assembly 400 is not used or deployed). Therefore, the gold-detection assembly 400 assists the prospector to locate the desirable aggregate that provides the desirable amount of placer gold simply by visually monitoring the gold-detection assembly 400 for trapped (retained) amount of placer gold. Once the amount of placer gold that is trapped and visually displayed to the prospector is desirable, the prospector can then focus on the site which provides this condition while avoiding continued prospecting of unproductive sites (thereby saving time).

The magnetite-separator assembly 500 includes the magnetite catcher 501 (such as a bucket or may be discarded as wastage. etc.). The magnetite-separator assembly 500 includes an input section configured to be in fluid communication with the gold-concentrator assembly 300 and with the gold-detection assembly 400. The magnetite-separator assembly 500 includes a magnetite output and a bypass output. The magnetite output of the magnetite-separator assembly 500 is configured to be in fluid communication with the magnetite catcher 501 in such a way that the collection 503 (magnetite) is movable (by gravity feed, etc.) from the magnetite-separator assembly 500 to the magnetite catcher 501. The bypass output of the magnetite-separator assembly 500 is configure to be in fluid communication with the sluice assembly 600 in such a way that the collection 505 (a mixture of placer gold, water, sand, etc.) is movable from the magnetite-separator assembly 500 to the sluice assembly 600 (by gravity feed, etc.).

The sluice assembly 600 is also known or also called a placer gold catcher. The sluice assembly 600 includes an input configured to be in fluid communication with the bypass output of the magnetite-separator assembly 500. The sluice assembly 600 includes an output configured to be in fluid communication with the settling pond 210 in such a way that the collection 601 (a mixture of water, sand, etc.) is movable from the sluice assembly 600 to the settling pond 210.

It will be appreciated that in view of the foregoing (in accordance with an example), the apparatus 100 includes (and is not limited to) the placer-gold processing system 200. The placer-gold processing system 200 includes an upstream section 202. The placer-gold processing system 200 also includes the gold-concentrator assembly 300 configured to be in fluid communication with the upstream section 202. The placer-gold processing system 200 also includes the gold-detection assembly 400 configured to be in fluid communication with the gold-concentrator assembly 300. The placer-gold processing system 200 also includes the magnetite-separator assembly 500 configured to be in fluid communication with the gold-concentrator assembly 300.

FIGS. 3*a* to 3*j* depict views of examples of the apparatus 100 of FIG. 1 having the placer-gold processing system 200 including a gold-concentrator assembly 300.

Figure 3A:
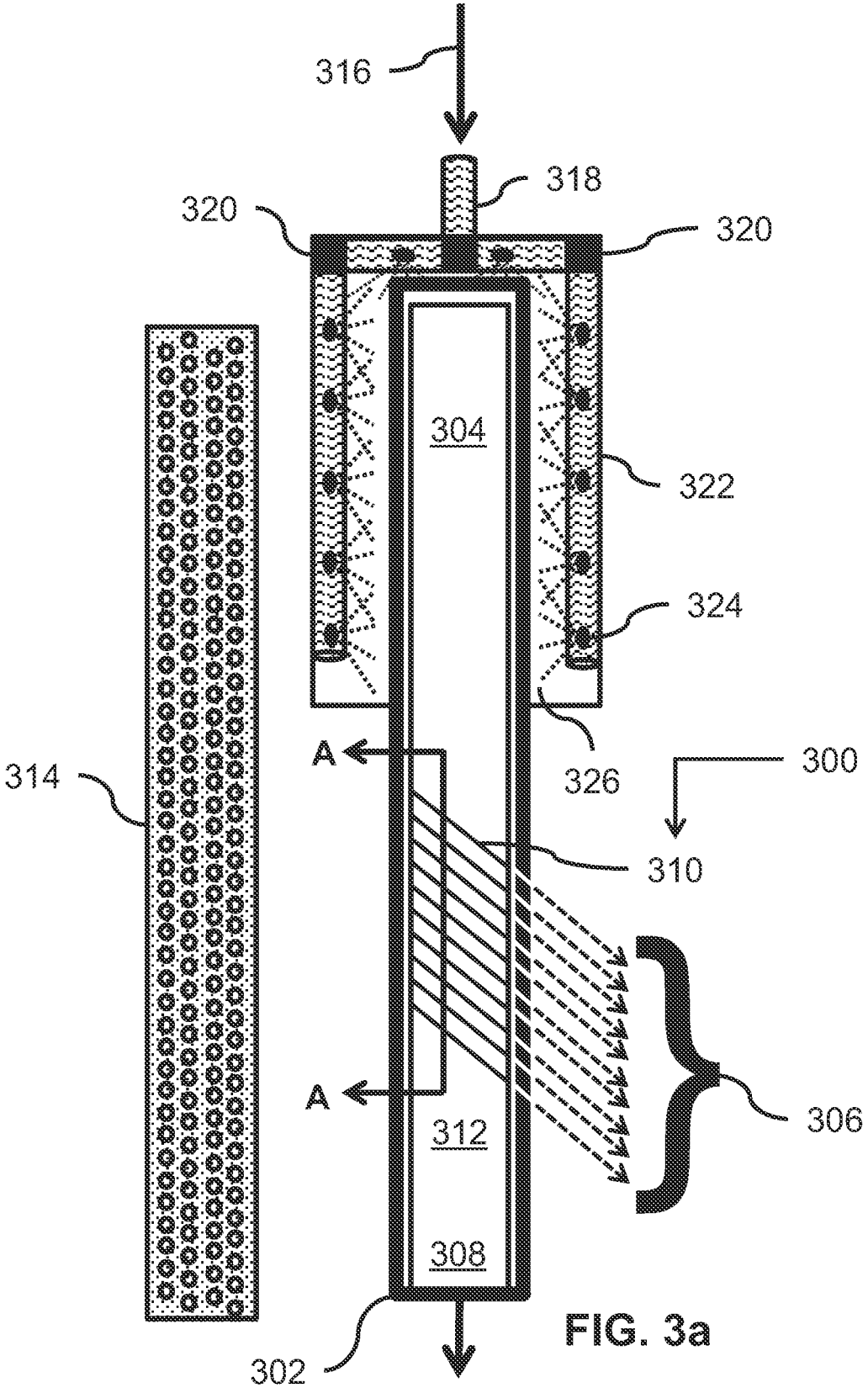
Figure 3B:
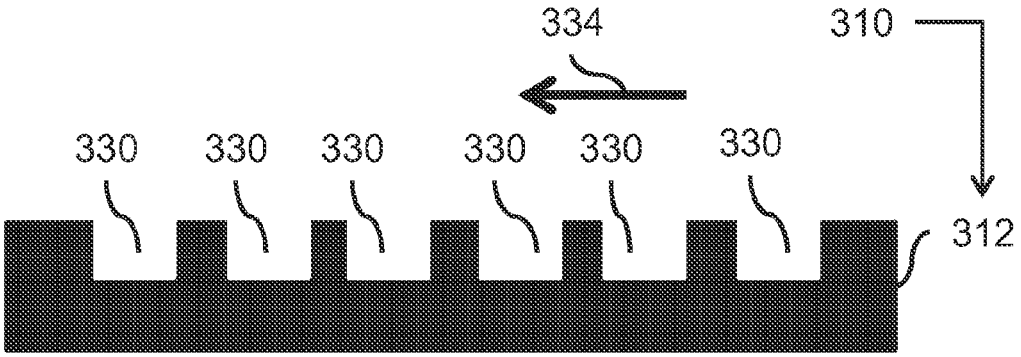
Figure 3C:
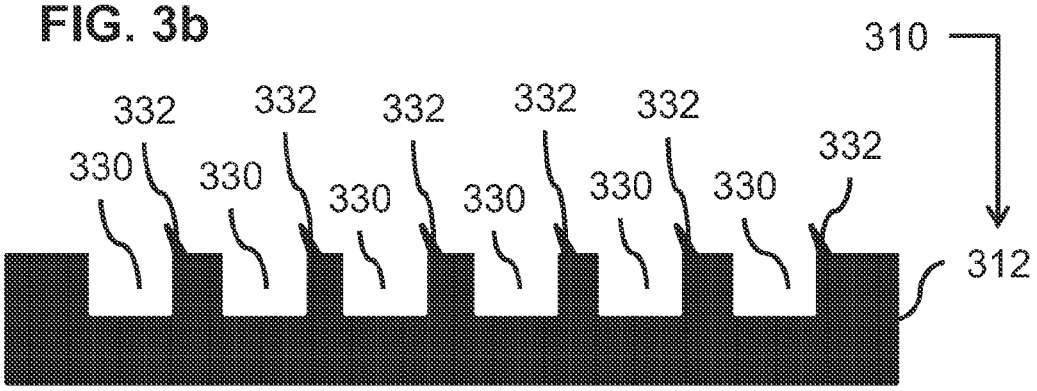
Figure 3D:
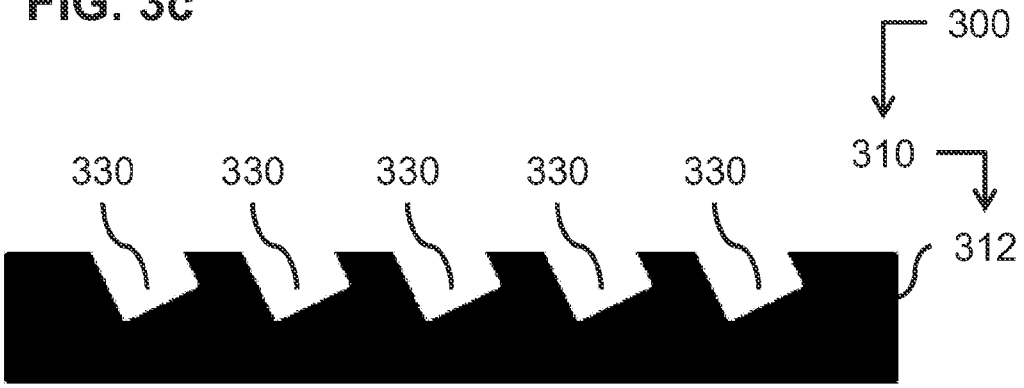
Figure 3E:
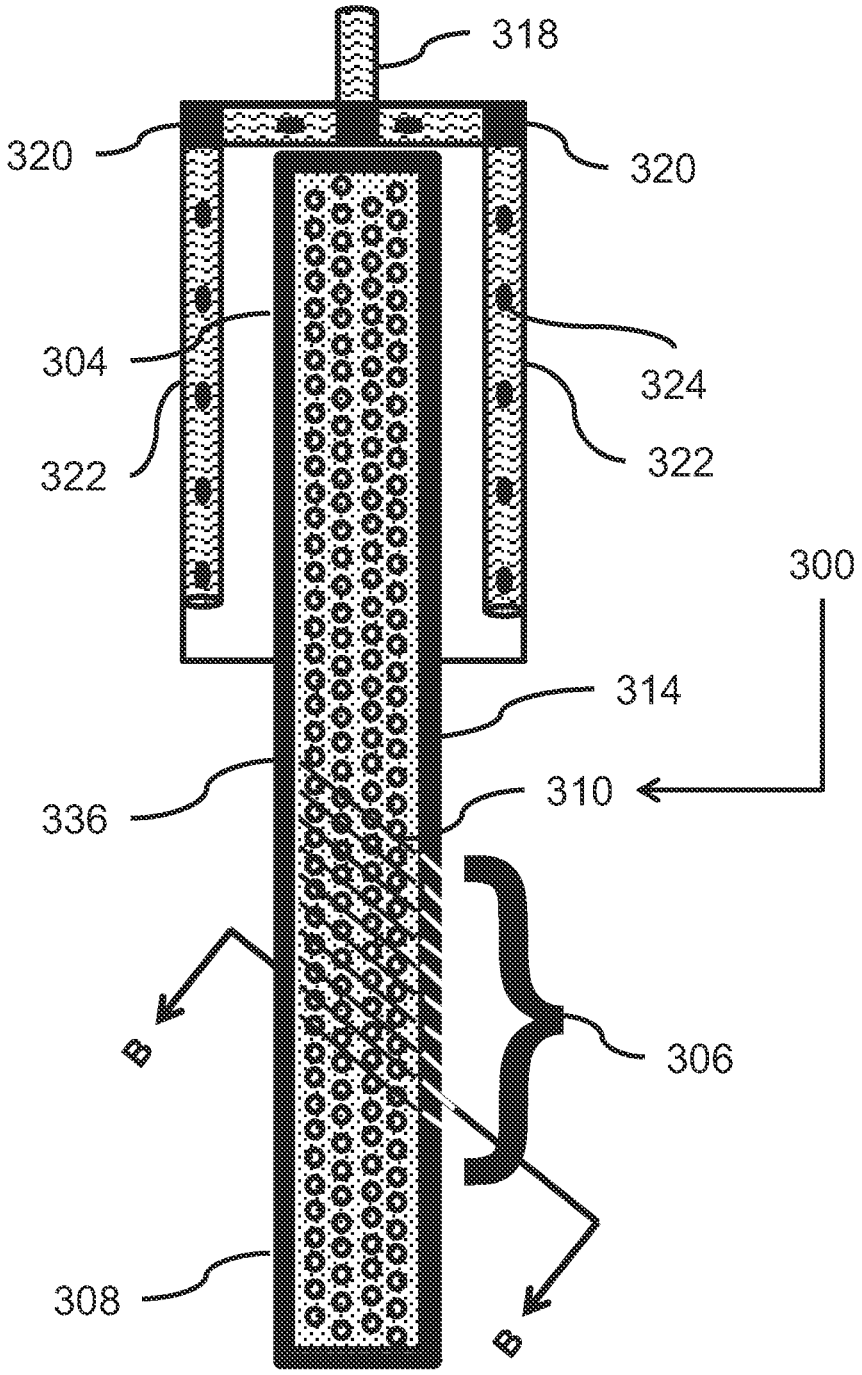
Figure 3F:
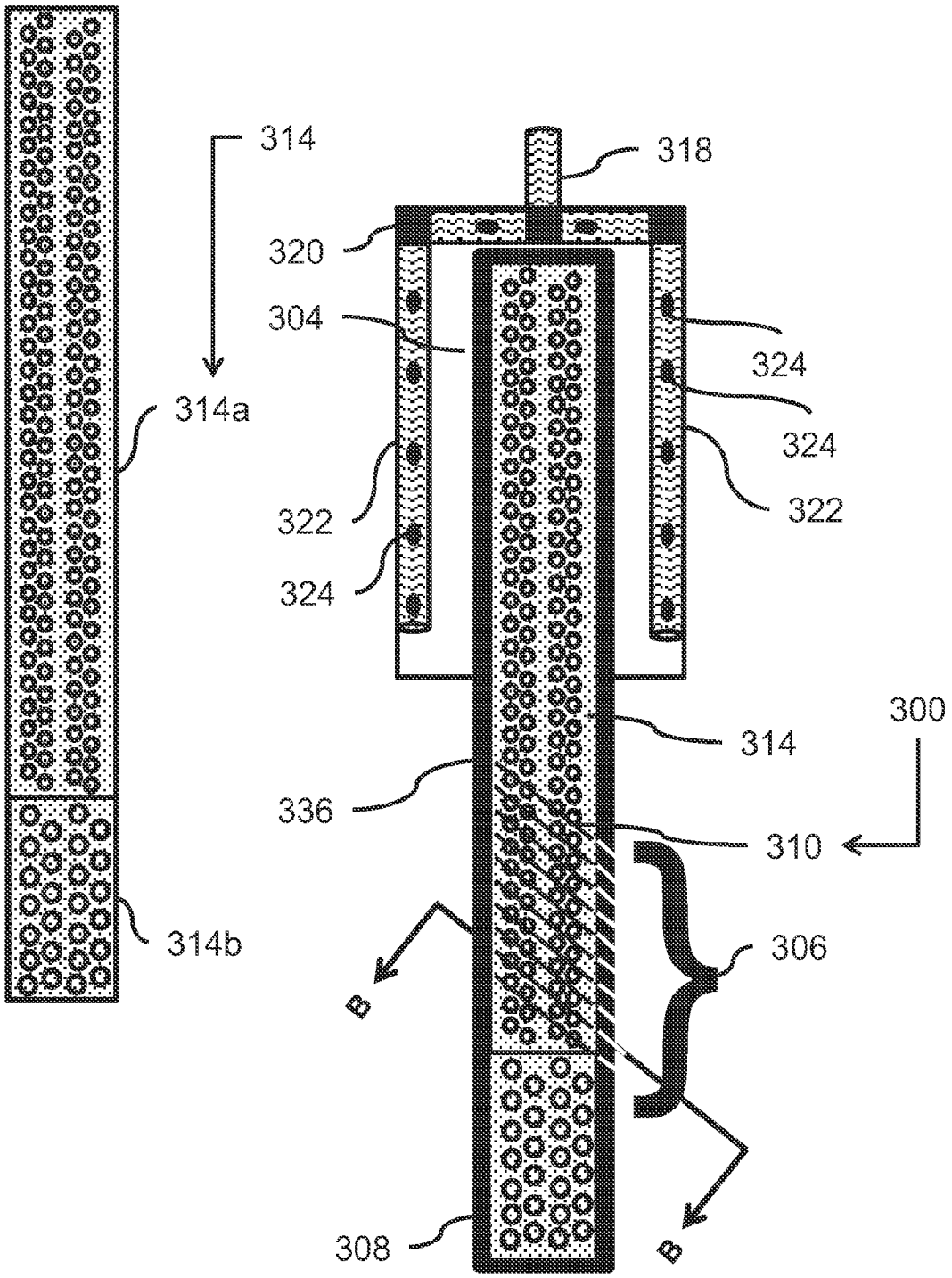
Figure 3G:
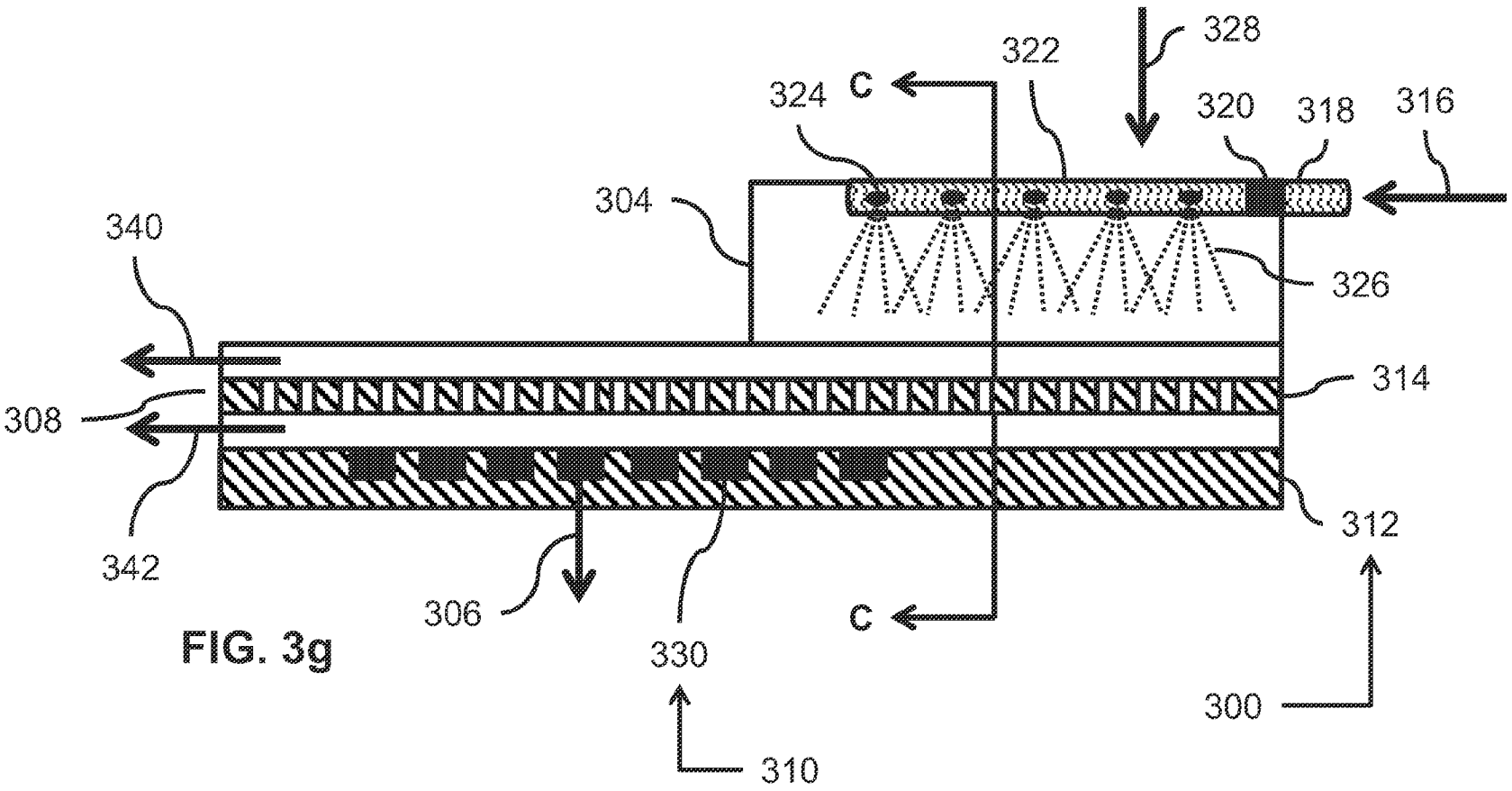
Figure 3H:
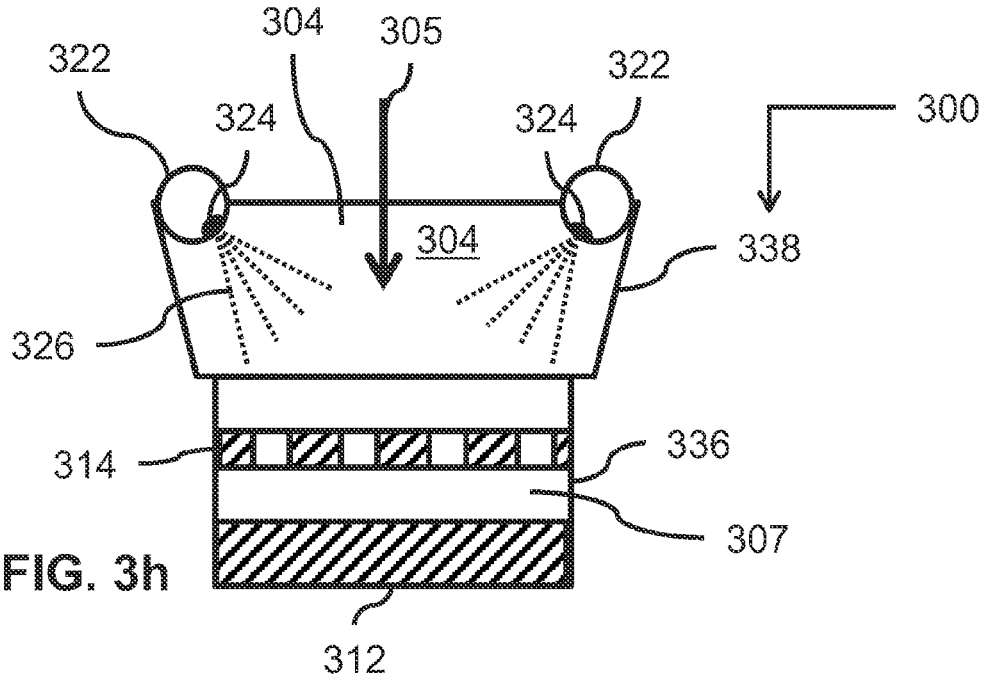
Figure 3I:
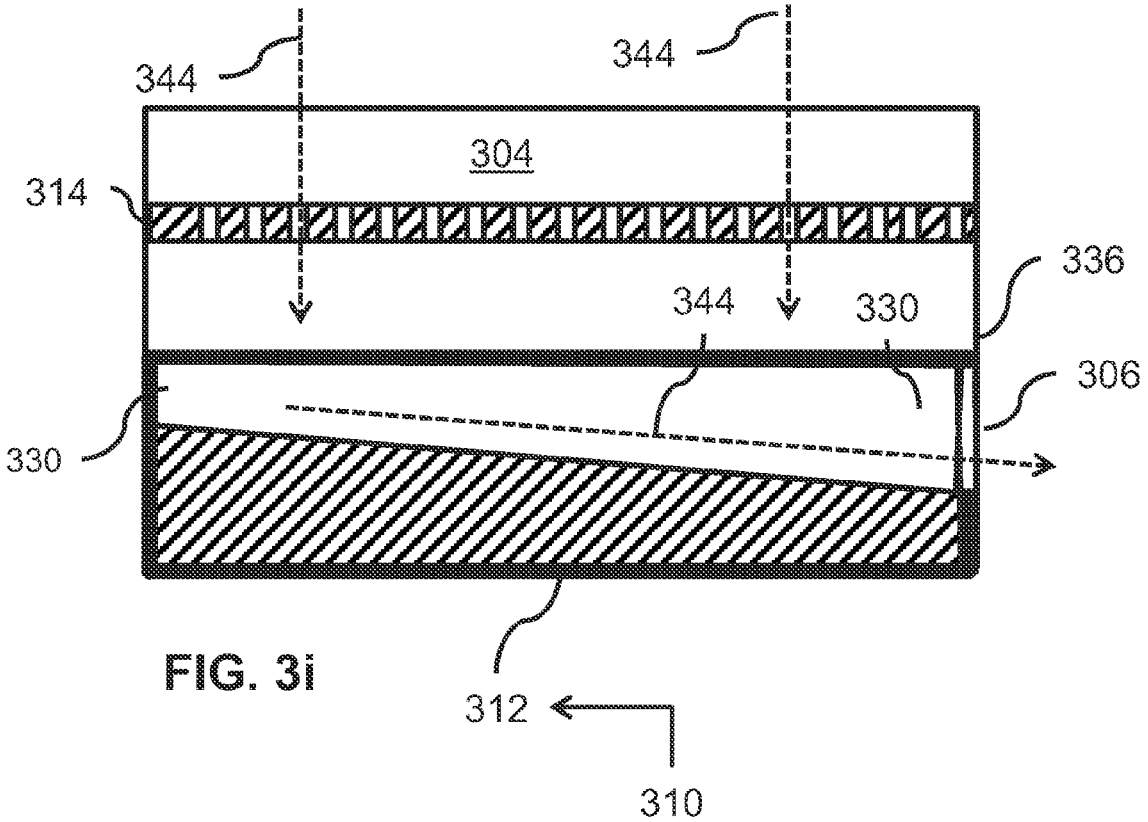
Figure 3J:
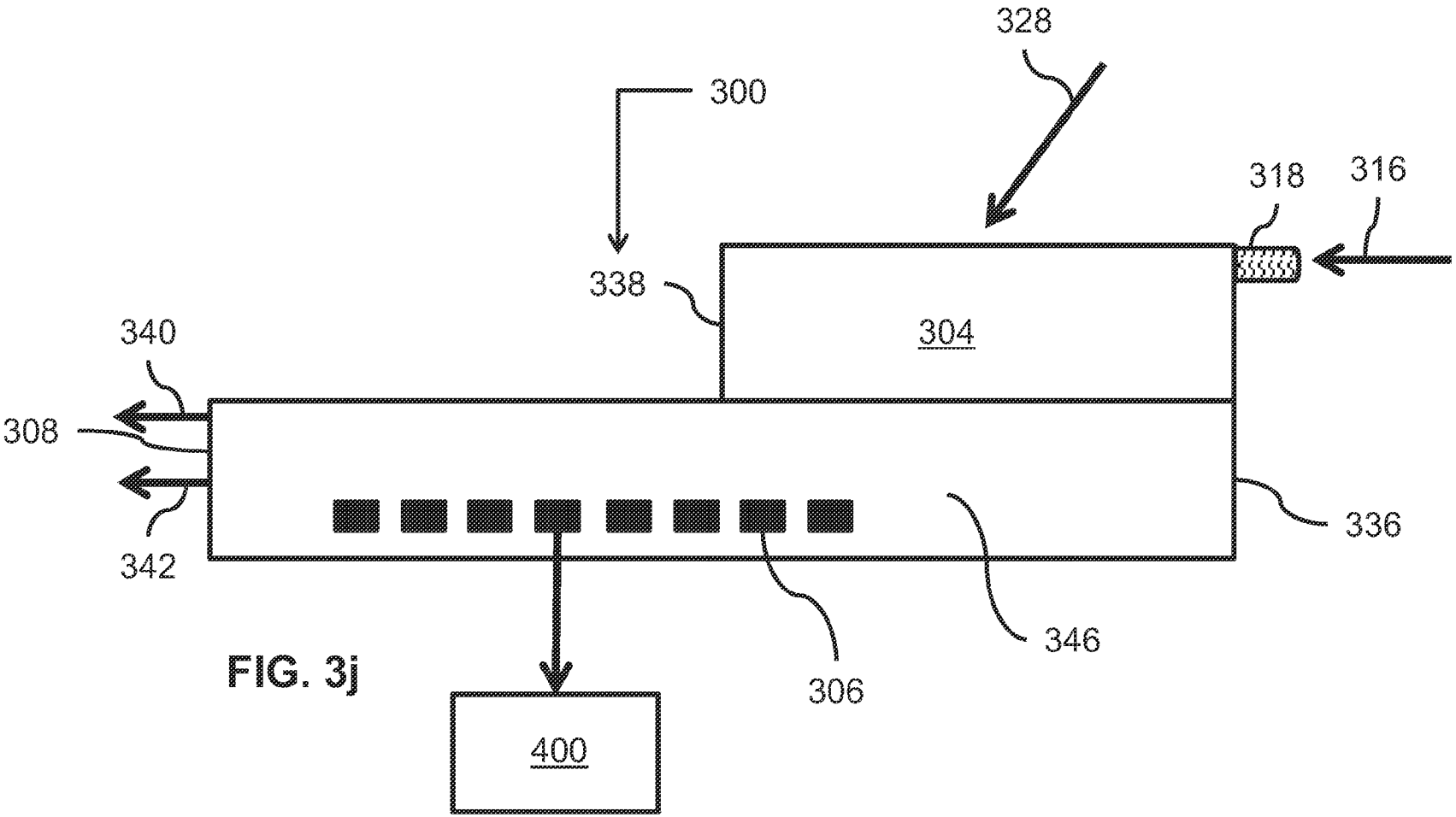

FIG. 3*a* depicts a top view; FIGS. 3*b*, 3*c*, and 3*d* depict cross-sectional views taken along line A-A of FIG. 3*a*; FIG. 3*e* depicts a top view; FIG. 3*f* depicts a top view; FIG. 3*g* depicts a side view; FIG. 3*h* depicts a cross-sectional view taken along line C-C (of FIG. 3C); FIG. 3*i* depicts a cross-sectional view taken along line B-B (of FIG. 3*f*); FIG. 3*j* depicts a side view.

FIGS. 3*a* to 3*j* depict the gold-concentrator assembly 300 having: a trough assembly 302, an input region 304, a diverter output region 306, a waste output region 308, a self-flushing rime region 310, a riffle body 312, a punch plate 314, a course mesh portion 314*b*, a fine mesh portion 314*a*, a water input 316, a water input tubing 318, a water connector 320, a water tubing 322, a spray nozzle 324, a spray nozzle 326, an aggregate input 328, a riffle groove 330, a riffle ledge 332, a water flow direction 334, a lower section 336, and an upper section 338. The diverter output region 306 is an output to the gold-detection assembly 400; the diverter output region 306 may be called a concentrated placer gold output. The waste output region 308 is an output to the settling pond 210 (FIG. 2), or an output to another stage of the apparatus 100. The punch plate 314 may also be called a mesh having a pattern that may be random or symmetrical, a fine screen, a woven screen, etc.

Referring to FIG. 3*a*, the input region 304 is configured to receive the fine slurry component from the grizzly filter section 204 (depicted in FIG. 2). At the input region 304, the water tubing 322 surrounds, at least in part, the input region 304 (as depicted along three sides of the input region 304). Sections of the water tubing 322 are connected together via the water connectors 320. The water input tubing 318 is configured to convey (in use) water to the water tubing 322. The spray nozzles 324 are provided by the water tubing 322; the spray nozzles 324 are configured to convey water from the water tubing 322 to the input region 304 in such a way that the fine slurry component received from the grizzly filter section 204 (FIG. 2) may be washed down (diluted) and movable along a length of the gold-concentrator assembly 300 toward the self-flushing riffle region 310. The riffle body 312, which is held by the gold-concentrator assembly 300, defines or provides the self-flushing riffle region 310. The self-flushing riffle region 310 may provide a set of grooves (at least one groove) that are angled relative to the longitudinal axis extending through the riffle body 312. The riffle body 312 may include a section of elongated lumber (wooden section), or an elongated plastic body. The rife body 312 may extend from the input region 304 to the waste output region 308. The outputs for each groove of the self-flushing riffle region 310 are oriented to one side of the gold-concentrator assembly 300 (at an accurate angle relative to the longitudinal axis extending through the riffle body 312).

The punch plate 314 is depicted as spaced apart from the riffle body 312 in order to provide an unobstructed view of the riffle body 312. The punch plate 314 may provide, for instance, a flat-body assembly configured to define a set of holes that extend through the flat-body assembly. For example, the punch plate 314 defines a plurality of pass-through channels that extend through a flat plate body of the punch plate 314. The sizing of the pass-through holes may be any suitable size; the punch plate 314 is configured to prevent the passage of a relatively courser material (courser slurry) from passing through the punch plate 314, while allowing relatively finer material (finer slurry) to pass through the punch plate 314.

Referring to FIG. 3*b*, the riffle body 312 of the gold-concentrator assembly 300 defines (in accordance with an example) riffle grooves 330 that are each spaced apart from each other along a length of the riffle body 312. The rime grooves 330 are configured to receive the placer gold; since the placer gold is heavier than water, the placer gold will fall (via gravity) into the riffle grooves 330 as the placer gold is made to travel along the water flow direction 334 (via draw from gravity). Any placer gold that is not received by the grooves may exit the gold-concentrator assembly 300 via the waste output region 308 (depicted in FIG. 3*a*). The rime grooves 330 have a flat bottom portion.

Referring to FIG. 3*c*, the riffle body 312 provides riffle ledges 332 in which the rime ledges 332 are positioned at an upstream position (location) relative to a corresponding riffle groove 330. The riffle ledges 332 extend upwardly from the riffle body 312, and are angled toward the downstream section of the riffle body 312.

Referring to FIG. 3*d*, the riffle grooves 330 are defined by the rime body 312 in such a way that the rime grooves 330 define or provide a v-shaped bottom portion. It will be appreciated that the rime grooves 330 may take on any suitable form.

Referring to FIG. 3*e*, the punch plate 314 is positioned (received) over top of the rime body 312 (thus covering the rime body 312 and the self-flushing riffle region 310). The punch plate 314 is paced apart from the rime body 312 in such a way as to form a region between the punch plate 314 and the riffle body 312.

Referring to FIG. 3*f*, in accordance with an example, there is depicted an example of the punch plate 314 having a fine mesh portion 314*a* and a course mesh portion 314*b*. The punch plate 314 of FIG. 3*f* may be used for the case where finer filtering of the slurry entering the gold-concentrator assembly 300 may be required or desired. In this way, the finer particles of the placer gold suspended in the slurry may be recovered more effectively.

Referring to FIG. 3*g*, the punch plate 314 is spaced apart from the riffle body 312. At the waste output region 308, there is provided a gravel output 340 and a bypass output 342. The bypass output 342 is configured to convey the placer gold that was not received by the self-flushing riffle region 310 to another stage of the placer-gold processing system 200. The gravel output 340 is configured to convey relatively larger particles to other stages of the placer-gold processing system 200. The gravel output 340 is configured to fluidly connect to the settling pond 210 (depicted in FIG. 2), or to the gold-nugget trap 208 (depicted in FIG. 2 if so desired). The bypass output 342 is configured to fluidly communicate with further processing stages of the placer-gold processing system 200, such as toward a sluice system (known and not depicted).

Referring to FIG. 3*h*, the upper section of the gold-concentrator assembly 300 is configured to receive the aggregate. The aggregate falls and rests on the punch plate 314. The punch plate 314 is fixedly held in position within the gold-concentrator assembly 300; the punch plate 314 is spaced apart from the self-flushing riffle region 310 that is defined (provided) by the riffle body 312; the riffle body 312 is fixedly positioned in the lower section 336 of the gold-concentrator assembly 300. In accordance to FIG. 3*h*, the lower section 336 may include an elongated open-sided trough or container having side walls and a bottom wall extending between the side walls. The upper section 338 includes tapered side walls extending upwardly and away from the sides walls of the lower section 336 that surround, at least in part the input region 304. The upper section 338 is a pass through structure having an open top side and an open bottom side. Direction 305 is the direction from which the aggregate enters the input region 304 via the upper section 338. A space 307 is formed between the punch plate 314 and the riffle body 312. The punch plate 314 is held in position within the lower section 336, and may be removable from the lower section 336 as may be required for cleaning and/or maintaining the lower section 336 and/or the riffle body 312. The riffle body 312 may be removable from the lower section 336. The lower section 336 and the upper section 338 may be fixedly connected together if desired. The water tubing 322 is connected to, at least in part, the top outer perimeter of the upper section 338. The spray nozzles 324 are pointed or oriented to the interior of the upper section 338 and toward the punch plate 314. Once the aggregate (or slurry) enters the input region 304 (not depicted), the aggregate rests on the punch plate 314, and the water from the spray nozzles 324 washes (in use) the aggregate (or slurry) that rests on the punch plate 314 becomes diluted so that the fine slurry may pass through the punch plate 314 while the course slurry may be conveyed along the top side of the punch plate 314 toward the waste output region 308 (FIG. 3*g*) of the gold-concentrator assembly 300.

Referring to FIG. 3*i*, the water flow 344 travels through the punch plate 314 (taking along the placer gold, etc.) to the riffle groove 330 provided by the riffle body 312 of the self-flushing riffle region 310. For instance, the riffle groove 330 may be 0.25 inches deep at the one side of the rime groove 330, and may be 0.5 inches deep at the other side of the riffle groove 330 where the diverter output region 306 is positioned (so that the placer gold may be funneled along the rime groove 330 toward the diverter output region 306 along the water flow 344).

Referring to FIG. 3*j*, for each riffle groove 330 of FIG. 3*b*, there is an output portal defined by the side wall 246 of the gold-concentrator assembly 300. Each output of the riffle groove 330 may be collected and directed to the gold-detection assembly 400 (if so desired).

In summary, with reference to FIGS. 3*a* to 3*j*, it will be appreciated in accordance with an option, the gold-concentrator assembly 300 may be provided separately from the gold-detection assembly 400 and/or the magnetite-separator assembly 500. For this case, the apparatus 100 includes (and is not limited to) the placer-gold processing system 200. The placer-gold processing system 200 includes the upstream section 202. The placer-gold processing system 200 also includes the gold-concentrator assembly 300. The gold-concentrator assembly 300 is configured to: (A) receive, at least in part, flowing water and placer gold from the upstream section 202 of the placer-gold processing system 200; and (B) divert, at least in part, the placer gold and the flowing water that was received away from a waste output region 308 and toward a diverter output region 306 in such a way that at least more of the placer gold travels through the diverter output region 306 than through the waste output region 308.

In view of the above example, there is provided a method of concentrating placer gold in an apparatus 100 having a placer-gold processing system 200, the method includes: (A) receiving, at least in part, flowing water and the placer gold from an upstream section 202 of the placer-gold processing system 200; and (B) diverting, at least in part, the placer gold and the flowing water that was received from the upstream section 202 away from a waste output region 308 and toward a diverter output region 306 in such a way that at least more of the placer gold travels through the diverter output region 306 than through the waste output region 308.

In summary (in accordance with an option), with reference to FIGS. 3*a* to 3*j*, the gold-concentrator assembly 300 is configured to: (A) receive, at least in part, flowing water and placer gold from the upstream section 202 of the placer-gold processing system 200; and (B) divert, at least in part, the placer gold and the flowing water that was received away from a waste output region 308 and toward a diverter output region 306 in such a way that at least more of the placer gold travels through the diverter output region 306 than through the waste output region 308.

In summary (in accordance with an option), with reference to FIGS. 3*a* to 3*j*, the gold-concentrator assembly 300 includes the trough assembly 302. The trough assembly 302 has (or includes) an input region 304 configured to fluidly receive flowing water carrying placer gold. The trough assembly 302 also has a diverter output region 306 configured to be in fluid communication with and positioned downstream from the input region 304; the diverter output region 306 is configured to output, at least in part, the flowing water provided by the input region 304. The trough assembly 302 also has the waste output region 308 configured to be in fluid communication with and positioned downstream from the input region 304; the waste output region 308 is configured to output, at least in part, the flowing water provided by the input region 304. The trough assembly 302 also has the self-flushing riffle region 310 configured to be positioned downstream from the input region 304 and upstream from the waste output region 308. The self-flushing riffle region 310 is configured to receive, at least in part, the flowing water and the placer gold arriving from the input region 304. The self-flushing riffle region 310 is also configured to divert, at least in part, the placer gold and the flowing water received from the input region 304 away from the waste output region 308 and toward the diverter output region 306 in such a way that at least more of the placer gold travels through the diverter output region 306 than through the waste output region 308.

FIGS. 4*a* to 4*c* depict views of examples of the apparatus 100 of FIG. 1 having the placer-gold processing system 200 including a gold-detection assembly 400.

FIG. 4*a* depicts a top view; FIG. 4*b* depicts a side view through a line A-A provided by FIG. 4*a*. FIG. 4*c* depicts a cross-sectional view through a line B-B provided by FIG. 4*b*.

FIGS. 4*a* to 4*c* depict the gold-detection assembly 400 having an open container assembly 402 (also called an open top trough or a tubular assembly, etc.), an input section 404, an output section 406, and a gold-indicator section 408.

The input flow 411 enters the input section of the gold-detection assembly 400. The gold-indicator section 408 may include, for example, sandpaper, course material, textured material, porous material, soft rubber, and/or a sticky material. The gold-indicator section 408 is configured to temporarily hold the placer gold. The gold-indicator section 408 is configured to retard motion of the placer gold. As depicted, some amount of the placer gold 409 is held by the gold-indicator section 408.

In accordance with an example, the gold-detection assembly 400 is configured to contact, at least in part, placer gold conveyed by flowing water received, at least in part, from the upstream section 202 of the placer-gold processing system 200. The gold-detection assembly 400 is configured to retard, at least in part, the motion of the placer gold relative to the flowing water as the flowing water moves through the gold-detection assembly 400. The gold-detection assembly 400 is configured to visually display, at least in part, the placer gold that is retarded from motion relative to the flowing water as the flowing water moves through the gold-detection assembly 400.

In accordance with an example, the gold-detection assembly 400 includes the open container assembly 402 having side walls and a bottom wall (the side walls surround, at least in part the bottom wall). The top side is open to permit inflow of water and placer gold (from an upstream section of the assembly 200). An opening is defined at one side of the side walls to permit the outflow of water and placer gold (that was not retained by the assembly 408) through the gold-detection assembly 400 (toward a downstream section of the assembly 200). One side of the open container assembly 402 has (or includes) the input section 404 configured to fluidly receive flowing water carrying placer gold. The open container assembly 402 also has an output section 406 in fluid communication with and positioned downstream from the input section 404; the output section 406 is configured to output the flowing water received from the input section 404. The open container assembly 402 also has the gold-indicator section 408 fixedly positioned downstream from the input section 404 and upstream from the output section 406. The gold-indicator section 408 is configured to contact, at least in part, the placer gold conveyed by the flowing water arriving from the input section 404. The gold-indicator section 408 is also configured to retard, at least in part, the motion of the placer gold relative to the flowing water as the flowing water moves toward the output section 406. The gold-indicator section 408 is configured to visually display, at least in part, the placer gold retarded from motion relative to the flowing water as the flowing water moves toward the output section 406.

In accordance with an option, the gold-detection assembly 400 may be provided separately from the gold-concentrator assembly 300 and the magnetite-separator assembly 500. For this case, the apparatus 100 includes (and is not limited to) the placer-gold processing system 200. The placer-gold processing system 200 includes the upstream section 202. The placer-gold processing system 200 also includes the gold-detection assembly 400 configured to contact, at least in part, placer gold conveyed by flowing water received, at least in part, from the upstream section 202 of the placer-gold processing system 200. The gold-detection assembly 400 is also configured to retard, at least in part, the motion of the placer gold relative to the flowing water as the flowing water moves through the gold-detection assembly 400. The gold-detection assembly 400 is also configured to visually display, at least in part, the placer gold retarded from motion relative to the flowing water as the flowing water moves through the gold-detection assembly 400.

In view of the above example, there is provided a method of detecting placer gold in an apparatus 100 having a placer-gold processing system 200. The method includes (A) contacting, at least in part, the placer gold that is conveyed by flowing water received, at least in part, from an upstream section 202 of the placer-gold processing system 200; (B) retarding, at least in part, the motion of the placer gold relative to the flowing water as the flowing water moves through the gold-detection assembly 400; and (C) visually displaying, at least in part, the placer gold that is retarded from motion relative to the flowing water as the flowing water moves through the gold-detection assembly 400.

FIGS. 5*a* and 5*b* depict views of examples of the apparatus 100 of FIG. 1 having the placer-gold processing system 200 including a gold-concentrator assembly 300 and a gold-detection assembly 400.

FIG. 5*a* depicts a side view; FIG. 5*b* depicts a top view.

The gold-concentrator assembly 300 is positioned over top of the gold-detection assembly 400; in this way, gravity may draw water through the gold-concentrator assembly 300 to the gold-detection assembly 400, and then through the gold-detection assembly 400 and out from the gold-detection assembly 400.

Referring to FIG. 5*b*, the output from the self-flushing rime region 310 of the gold-concentrator assembly 300 is directed toward the gold-indicator section 408 of the gold-detection assembly 400. The gold-concentrator assembly 300 is configured to concentrate (catch, retain) placer gold that is moved along by flowing water. River gravel is shoveled (placed) into the input region 304 (a top positioned tray) and the spray nozzles 324 wash the river gravel over the punch plate 314. Fine material washes through the punch plate 314, while coarse rock (material) washes over the punch plate 314 (and then the course material may be discarded). The fine material goes into the tray located below the punch plate 314, and the majority of the heavy material and placer gold drop into the angled self-cleaning riffles included in the self-flushing riffle region 310. The grooved riffles of the self-flushing riffle region 310 may be positioned at a 45 degree angle (plus or minus) relative to the longitudinal axis that extends through the riffle body 312 of the gold-concentrator assembly 300. The grooves of the self-flushing riffle region 310 (such as those depicted in FIG. 3*b*) may be tapered from ¼ inch to ½ inch deep (as depicted in FIG. 3*i*). The riffle grooves 330 run under the side wall of the tray of the gold-concentrator assembly 300, and into the gold-detection assembly 400 (as depicted in FIGS. 5*a* and 5*b*) where placer gold may become retained, at least in part, by the gold-detection assembly 400. The gold-detection assembly 400 includes a trough with a piece of wet sand paper or wet and dry sand paper positioned on the bottom of the trough. Since placer gold is the heaviest of the concentrates, the placer gold lags behind as the material washes down to the next step (stage, via gravity fed). The gold-detection assembly 400 provides an opportunity to view whether there is any placer gold in each shovel of gravel feed into the gold-concentrator assembly 300.

FIGS. 6*a* to 6*e* depict views of examples of the apparatus 100 of FIG. 1 having a placer-gold processing system 200 including a magnetite-separator assembly 500.

Figure 6A:
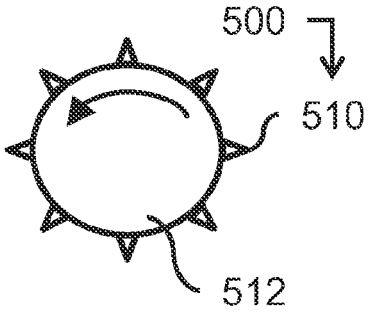
Figure 6B:
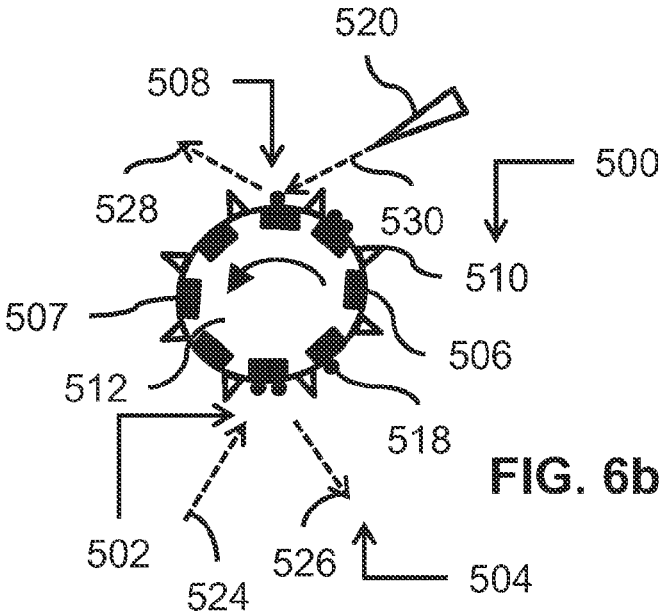
Figure 6C:
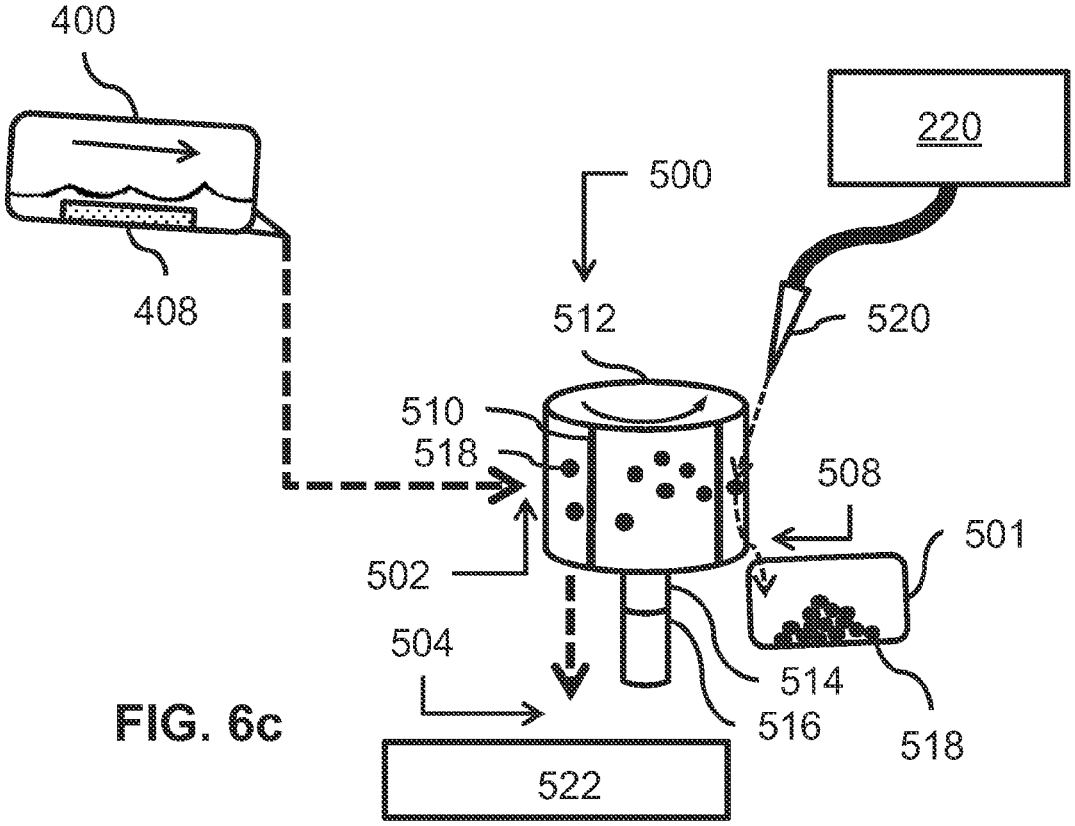
Figure 6D:
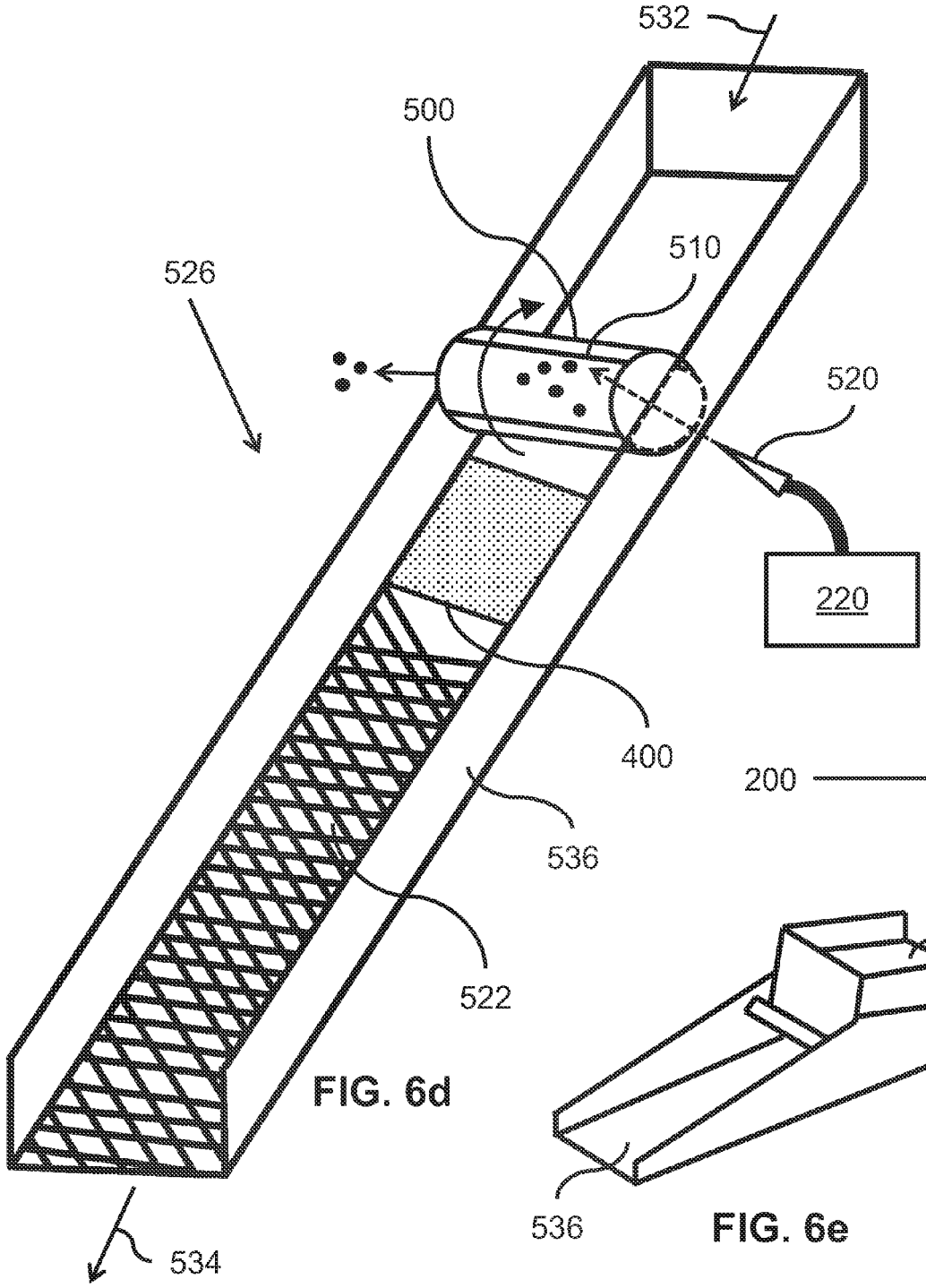
Figure 6E:
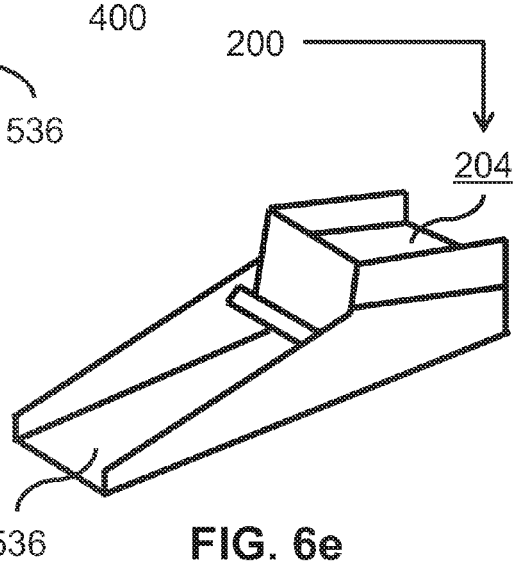

FIG. 6*a* depicts a top view; FIG. 6*b* depicts a top view; FIG. 6*c* depicts a perspective view; FIG. 6*d* depicts a perspective view; FIG. 6*e* depicts a perspective view.

FIGS. 6*a* to 6*e* depict the magnetite-separator assembly 500, an input area 502, an output area 504, a magnetite-attraction area 506 (also called a magnet), a magnetite output area 508, a paddle 510, a disk 512 (also called a drum), a bearing 514, a stationary shaft 516, magnetite 518 (particles of magnetite), a nozzle 520, a sluice box 522 (known), a first direction 524 (input flow), a second direction 526 (output flow of water and placer gold), a third direction 528 (outflow flow of magnetite), and a water spray 530 (provided by the nozzle 520).

Referring to FIG. 6*a*, the magnetite-separator assembly 500 includes a disk 512, and paddles 510 that extend radially from the disk 512. The disk 512 is configured to rotate. The input of water and slurry onto magnetite-separator assembly 500 helps to drive (operate) the magnetite-separator assembly 500 (that is, to rotate the magnetite-separator assembly 500).

Referring to FIG. 6*b*, the magnetite-attraction area 506 includes magnets 507 mounted in the interior (or to the exterior) of the disk 512. The magnetite is directed (from the gold-detection assembly 400) toward an outer surface of the disk 512 along the first direction 524 to an input area 502 of the magnetite-separator assembly 500. The placer gold and fine sand may deflect from the outer surface of the disk 512 to the sluice assembly 600 (as depicted in FIG. 6*c*) along the second direction 526 to the output area 504 of the magnetite-separator assembly 500. The nozzle 520 is oriented toward one side of the disk 512 at the magnetite output area 508 of the magnetite-separator assembly 500. The nozzle 520 is configured to direct a stream of water, via a water spray 530, with enough strength that the magnetite 518 that is held by the magnet 507 is knocked off the disk 512 and travels along the third direction 528. In addition, as the disk 512 rotates, the water spray 530 strikes the paddles 510 thus urging the disk 512 to rotate.

Referring to FIG. 6*c*, the nozzle 520 is configured to spray water toward the disk 512 in such a way that the magnetite 518 becomes knocked off the outer surface of the disk 512 (since the magnet inside the disk 512 can no longer magnetically attract the magnetite 518 to the disk 512). The magnetite 518 may fall into the magnetite catcher 501. The placer gold and fine sand may fall into the sluice assembly 600 (by gravity feed).

The magnetite-separator assembly 500 includes magnets positioned in a metal drum mounted on the stationary shaft 516 and the bearing 514. The magnets are stuck around the inside (or the outside) section of the metal drum. The outside of the drum is covered with grooved rubber matting. The magnetite-separator assembly 500 is configured to magnetically attract (pull) magnetite out of the fine sand and flowing water. The magnetite is the next heaviest thing to the placer gold, and also has magnetic properties. Fine material from both the gold-concentrator assembly 300 and/or from the gold-detection assembly 400 washes onto the magnetite-separator assembly 500. As the magnet turns, the magnetite sticks to the drum while the placer gold and the sand fall into the sluice assembly 600. The magnetite is washed lightly by a spray nozzle (known and not depicted) at the input area 502 which cleans any remaining placer gold and non-magnetic materials into the sluice assembly 600 (if so desired). The disk 512 turns and carries the magnetite 518 over the edge of the sluice assembly 600, and the magnetite 518 is blasted off (removed) from the magnetite-separator assembly 500 with a high pressured spray and discarded (or may be retained if desired). The spray nozzles and the feeds are angled slightly in order to propel the magnetite-separator assembly 500. Now that there is only non-magnetic light sand and placer gold running through the sluice assembly 600, the sluice assembly 600 separates the light sand out more efficiently (and this results in improved gold recovery in the sluice assembly 600). The disk 512 is rotatably mounted to a bearing 514; the bearing 514 is supported by the stationary shaft 516. The stationary shaft 516 of the magnetite-separator assembly 500 is aligned vertically. The magnetite-separator assembly 500 is configured to rotate in response to water flow striking the outer surface of the magnetite-separator assembly 500.

Referring to FIG. 6*d*, an elongated trough 536 is oriented such that flowing water enters via the input flow direction 532. The magnetite-separator assembly 500 is mounted to the trough in such a way that the rotation axis of the magnetite-separator assembly 500 extends across the width of the elongated trough 536 (an elongated open sided container). The nozzle 520 is oriented to shoot (spray) water across the outer surface of the disk 512. The flowing water that flows through the trough strikes the paddle 510 of the magnetite-separator assembly 500. Since the paddle 510 extends across the width of the elongated trough 536, the flowing water causes the magnetite-separator assembly 500 to rotate; as the magnetite-separator assembly 500 rotates in the flowing water, the magnetite-separator assembly 500 removes the magnetite from the flowing water, and the nozzle 520 removes the magnetite from the magnetite-separator assembly 500. The rotational axis of the magnetite-separator assembly 500 is aligned horizontally. Below the magnetite-separator assembly 500, there is positioned a sluice box 522. From the grizzly filter section 204 of FIG. 1, the water flows along an input flow direction 532, and the output flow direction 534 is oriented to flow to the settling pond 210.

Referring to FIG. 6*e*, there is depicted an example of the elongated trough 536 positioned in the placer-gold processing system 200.

Referring to FIGS. 6*a* to 6*e*, in accordance with an example, the magnetite-separator assembly 500 is configured to receive, at least in part, flowing water and magnetite particles arriving from an input area 502. The magnetite-separator assembly 500 is also configured to divert, at least in part, the magnetite particles received, at least in part, from the upstream section 202 of the placer-gold processing system 200.

Referring to FIGS. 6*a* to 6*e*, in accordance with another example, the magnetite-separator assembly 500 includes an input area 502 configured to fluidly receive flowing water carrying magnetite particles. The magnetite-separator assembly 500 also includes an output area 504 in fluid communication with and positioned downstream from the input area 502; the output area 504 is configured to output the flowing water that was received from the input area 502. The magnetite-separator assembly 500 also includes a magnetite-attraction area 506 having a magnetite output area 508. The magnetite-attraction area 506 is positioned downstream from the input area 502 and upstream from the output area 504. The magnetite-attraction area 506 is configured to receive, at least in part, the flowing water and the magnetite particles arriving from the input area 502. The magnetite-attraction area 506 is also configured to divert, at least in part, the magnetite particles that were received away from the output area 504 and toward the magnetite output area 508 in such a way that more of the magnetite particles travel toward the magnetite output area 508 than through the output area 504. The magnetite-attraction area 506 may be further configured to magnetically attract, at least in part, the magnetite particles away from the flowing water. The magnetite-attraction area 506 may be further configured to rotatably move, at least in part, the magnetite particles that were attracted away from the flowing water to the magnetite output area 508. The magnetite-attraction area 506 may be further configured to: (A) release, at least in part, magnetic attraction of the magnetite particles in response to a stream of water from a nozzle striking the magnetite particles in such a way that the magnetite particles that were released enter the magnetite output area 508, and/or (B) be rotated by water and slurry flow.

It will be appreciated that, in accordance with an option, the magnetite-separator assembly 500 may be provided separately from the gold-concentrator assembly 300 and the gold-detection assembly 400, in this case, the apparatus 100 includes (and is not limited to) the placer-gold processing system 200. The placer-gold processing system 200 includes the upstream section 202. The placer-gold processing system 200 also includes the magnetite-separator assembly 500 configured to receive, at least in part, the flowing water and the magnetite particles received, at least in part, from the upstream section 202 of the placer-gold processing system 200. The magnetite-separator assembly 500 is also configured to divert, at least in part, the magnetite particles that are received toward a magnetite output area 508.

In view of the example provided above, there is also provided a method of separating magnetite in an apparatus 100 having a placer-gold processing system 200. The method includes: (A) receiving, at least in part, flowing water and the magnetite particles received, at least in part, from an upstream section 202 of the placer-gold processing system 200; and (B) diverting, at least in part, the magnetite particles that are received toward a magnetite output area 508.

FIGS. 7*a* to 7*m* depict schematic representations of examples of the apparatus 100 of FIG. 1.

Figure 7A:
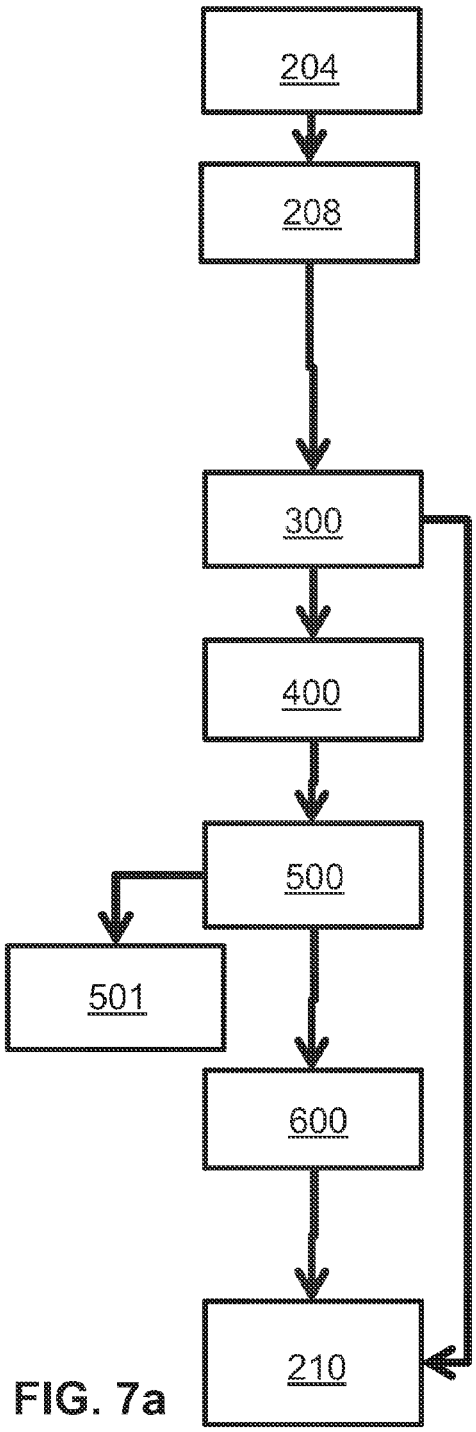

In accordance with the example depicted in FIG. 7*a*, the output of the grizzly filter section 204 is in fluid communication with the input of the gold-nugget trap 208. The output of the gold-nugget trap 208 is in fluid communication with the input of the gold-concentrator assembly 300. The bypass output of the gold-concentrator assembly 300 is in fluid communication with the settling pond 210. The concentrator output of the gold-concentrator assembly 300 is in fluid communication with the input of the gold-detection assembly 400. The output of the gold-detection assembly 400 is in fluid communication with the input of the magnetite-separator assembly 500. The magnetite output of the magnetite-separator assembly 500 is in fluid communication with the magnetite catcher 501. The bypass output of the magnetite-separator assembly 500 is in fluid communication with the input of the sluice assembly 600. The bypass output of the sluice assembly 600 is in fluid communication with the settling pond 210. It is understood that the sluice assembly 600 retains the placer gold.

Figure 7B:
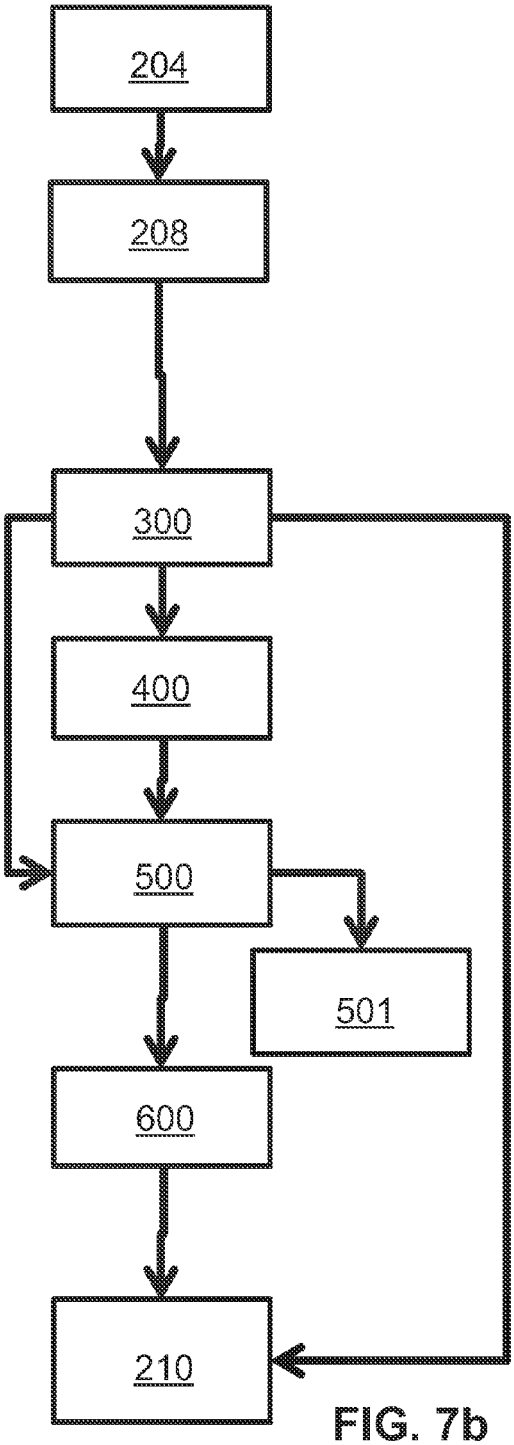

In accordance with the example depicted in FIG. 7*b*, the output of the grizzly filter section 204 is in fluid communication with the input of the gold-nugget trap 208. The output of the gold-nugget trap 208 is in fluid communication with the input of the gold-concentrator assembly 300. The bypass output of the gold-concentrator assembly 300 is in fluid communication with the magnetite-separator assembly 500. The waste output of the gold-concentrator assembly 300 is in fluid communication with the settling pond 210. The concentrator output of the gold-concentrator assembly 300 is in fluid communication with the input of the gold-detection assembly 400. The output of the gold-detection assembly 400 is in fluid communication with the input of the magnetite-separator assembly 500. The magnetite output of the magnetite-separator assembly 500 is in fluid communication with the magnetite catcher 501. The bypass output of the magnetite-separator assembly 500 is in fluid communication with the input of the sluice assembly 600. The bypass output of the sluice assembly 600 is in fluid communication with the settling pond 210. It is understood that the sluice assembly 600 retains the placer gold.

Figure 7C:
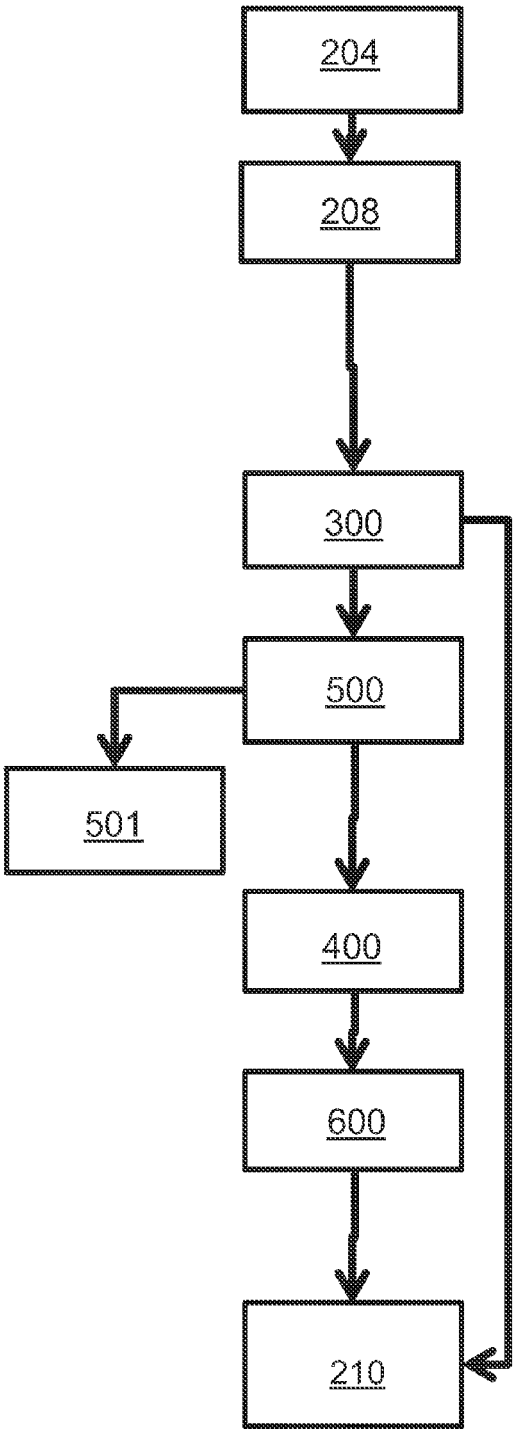

In accordance with the example depicted in FIG. 7*c*, the output of the grizzly filter section 204 is in fluid communication with the input of the gold-nugget trap 208. The output of the gold-nugget trap 208 is in fluid communication with the input of the gold-concentrator assembly 300. The waste output of the gold-concentrator assembly 300 is in fluid communication with the settling pond 210. The concentrator output of the gold-concentrator assembly 300 is in fluid communication with the input of the magnetite-separator assembly 500. The magnetite output of the magnetite-separator assembly 500 is in fluid communication with the magnetite catcher 501. The bypass output of the magnetite-separator assembly 500 is in fluid communication with the input of the gold-detection assembly 400. The output of the gold-detection assembly 400 is in fluid communication with the input of the sluice assembly 600. The bypass output of the sluice assembly 600 is in fluid communication with the settling pond 210. It is understood that the sluice assembly 600 retains the placer gold.

Figure 7D:
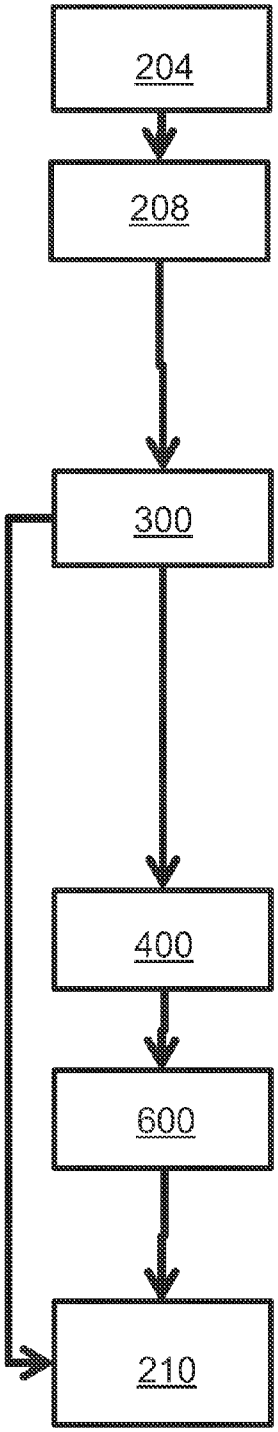

In accordance with the example depicted in FIG. 7*d*, the output of the grizzly filter section 204 is in fluid communication with the input of the gold-nugget trap 208. The output of the gold-nugget trap 208 is in fluid communication with the input of the gold-concentrator assembly 300. The output of the gold-concentrator assembly 300 is in fluid communication with the gold-detection assembly 400. The waste output of the gold-concentrator assembly 300 is in fluid communication with the settling pond 210. The concentrator output of the gold-concentrator assembly 300 is in fluid communication with the input of the gold-detection assembly 400. The output of the gold-detection assembly 400 is in fluid communication with the input of the sluice assembly 600. The bypass output of the sluice assembly 600 is in fluid communication with the settling pond 210. It is understood that the sluice assembly 600 retains the placer gold.

Figure 7E:
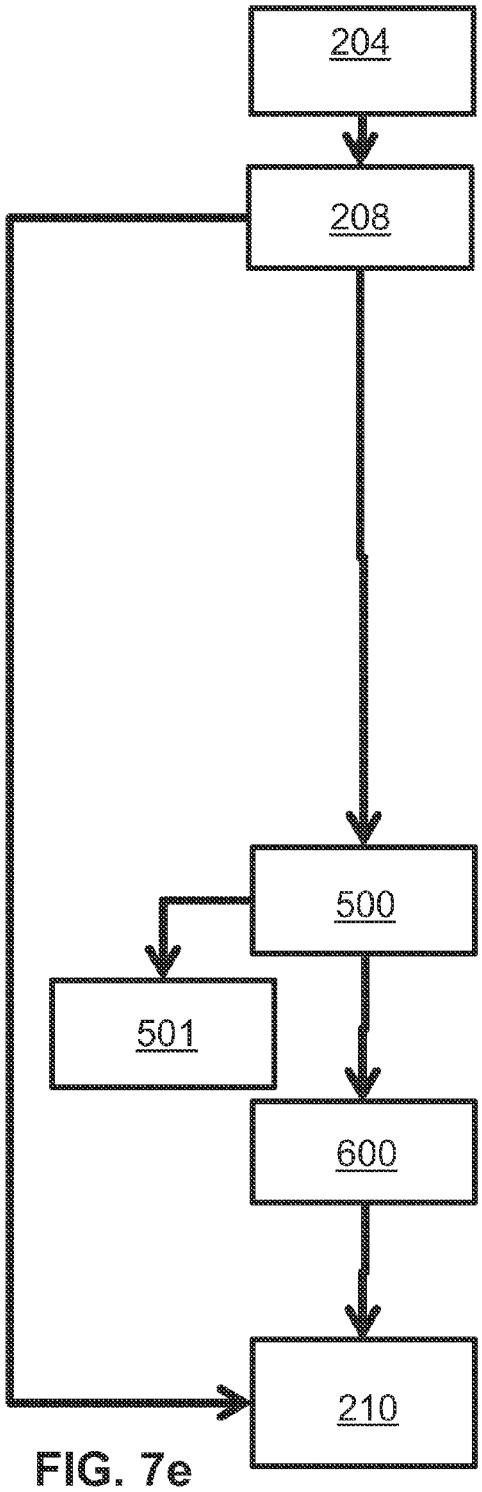

In accordance with the example depicted in FIG. 7*e*, the output of the grizzly filter section 204 is in fluid communication with the input of the gold-nugget trap 208. The output of the gold-nugget trap 208 is in fluid communication with the input of the magnetite-separator assembly 500. Another output of the gold-nugget trap 208 may be connected to the settling pond 210 (if so desired for overflow purposes). The magnetite output of the magnetite-separator assembly 500 is in fluid communication with the magnetite catcher 501. The bypass output of the magnetite-separator assembly 500 is in fluid communication with the input of the sluice assembly 600. The bypass output of the sluice assembly 600 is in fluid communication with the settling pond 210. It is understood that the sluice assembly 600 retains the placer gold.

Figure 7F:
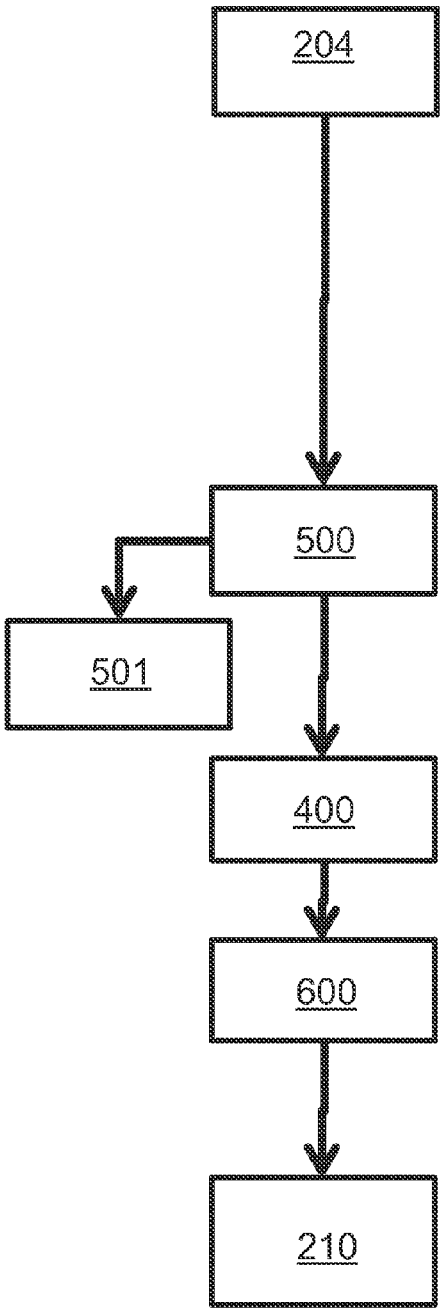

In accordance with the example depicted in FIG. 7*f*, the output of the grizzly filter section 204 is in fluid communication with the input of the magnetite-separator assembly 500. The magnetite output of the magnetite-separator assembly 500 is in fluid communication with the magnetite catcher 501. The bypass output of the magnetite-separator assembly 500 is in fluid communication with the input of the gold-detection assembly 400. The output of the gold-detection assembly 400 is in fluid communication with the input of the sluice assembly 600. The bypass output of the sluice assembly 600 is in fluid communication with the settling pond 210. It is understood that the sluice assembly 600 retains the placer gold.

Figure 7G:
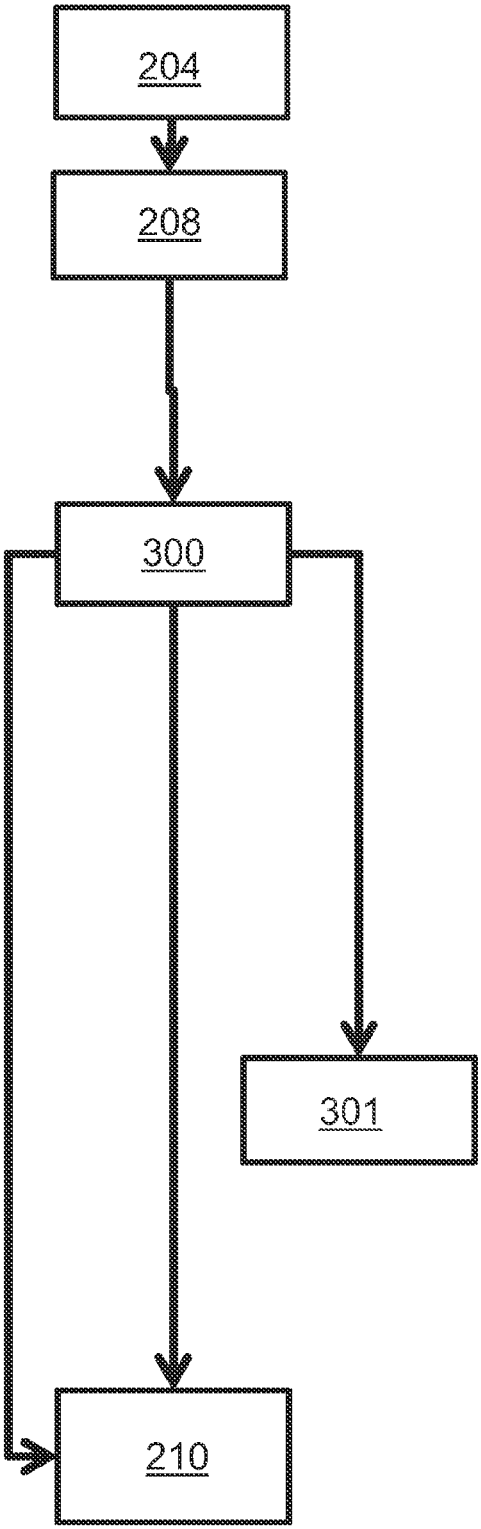

In accordance with the example depicted in FIG. 7*g*, the output of the grizzly filter section 204 is in fluid communication with the input of the gold-nugget trap 208. The output of the gold-nugget trap 208 is in fluid communication with the input of the gold-concentrator assembly 300. The bypass output of the gold-concentrator assembly 300 is in fluid communication with the settling pond 210. The payload output of the gold-concentrator assembly 300 is in fluid communication with a catcher 301; the catcher 301 may capture material to be further processed at a later time, by a sluice assembly.

Figure 7H:
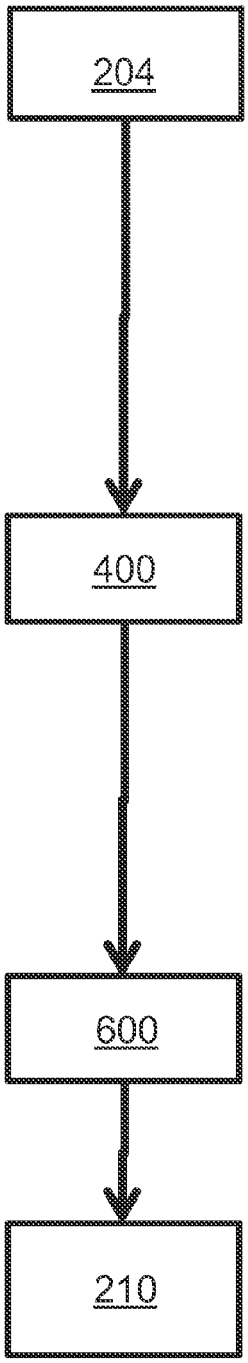

In accordance with the example depicted in FIG. 7*h*, the output of the grizzly filter section 204 is in fluid communication with the input of the gold-detection assembly 400. The output of the gold-detection assembly 400 is in fluid communication with the input of the sluice assembly 600. The bypass output of the sluice assembly 600 is in fluid communication with the settling pond 210. It is understood that the sluice assembly 600 retains the placer gold.

Figure 7I:
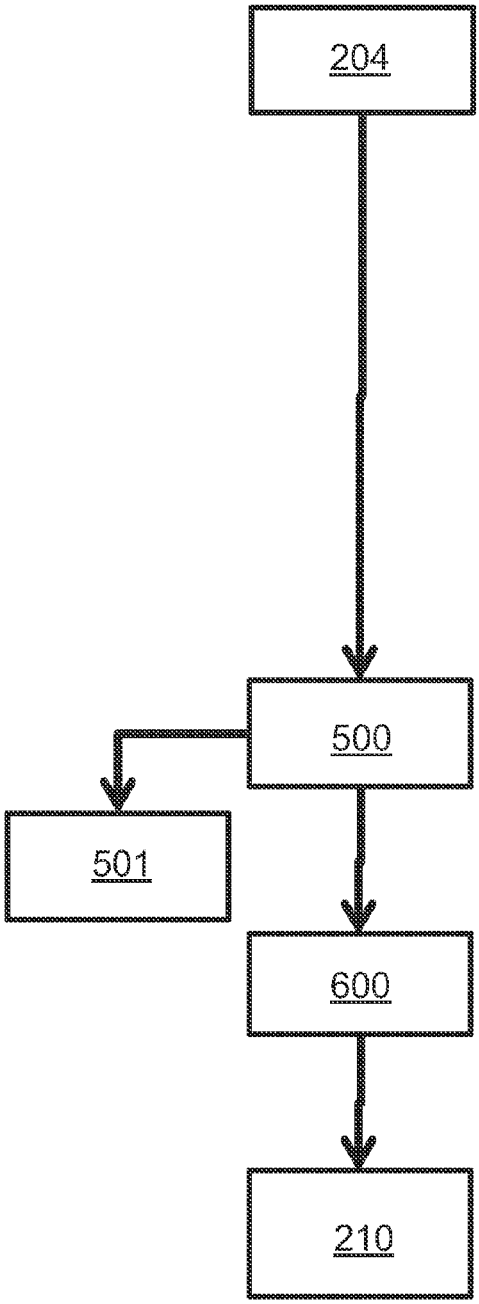

In accordance with the example depicted in FIG. 7*i*, the output of the grizzly filter section 204 is in fluid communication with the input of the magnetite-separator assembly 500. The magnetite output of the magnetite-separator assembly 500 is in fluid communication with the magnetite catcher 501. The bypass output of the magnetite-separator assembly 500 is in fluid communication with the input of the sluice assembly 600. The bypass output of the sluice assembly 600 is in fluid communication with the settling pond 210. It is understood that the sluice assembly 600 retains the placer gold.

Figure 7J:
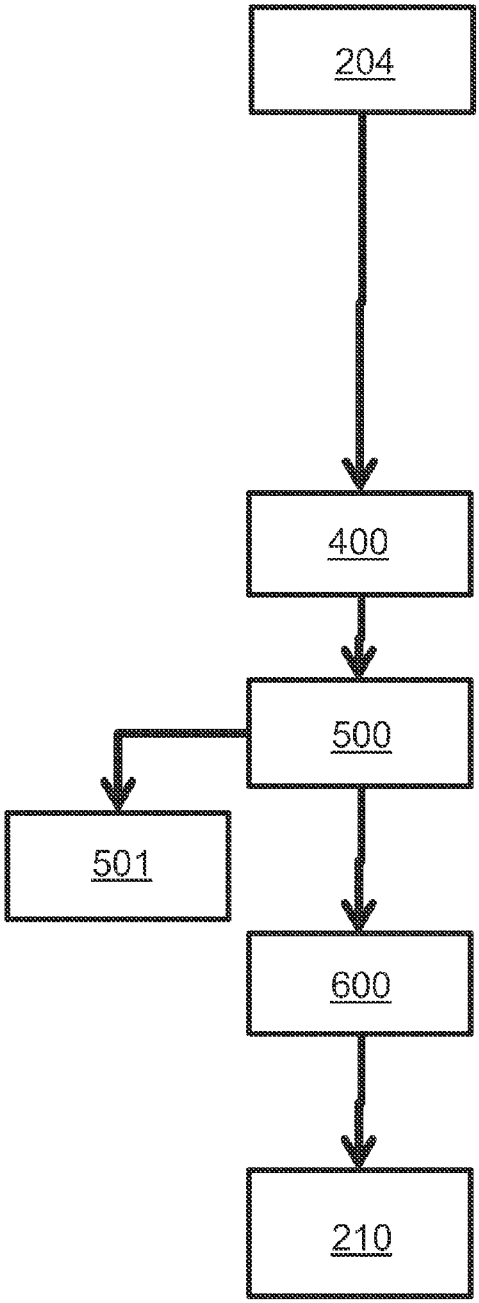

In accordance with the example depicted in FIG. 7*j*, the output of the grizzly filter section 204 is in fluid communication with the input of the gold-detection assembly 400. The output of the gold-detection assembly 400 is in fluid communication with the input of the magnetite-separator assembly 500. The magnetite output of the magnetite-separator assembly 500 is in fluid communication with the magnetite catcher 501. The bypass output of the magnetite-separator assembly 500 is in fluid communication with the input of the sluice assembly 600. The bypass output of the sluice assembly 600 is in fluid communication with the settling pond 210. It is understood that the sluice assembly 600 retains the placer gold.

Figure 7K:
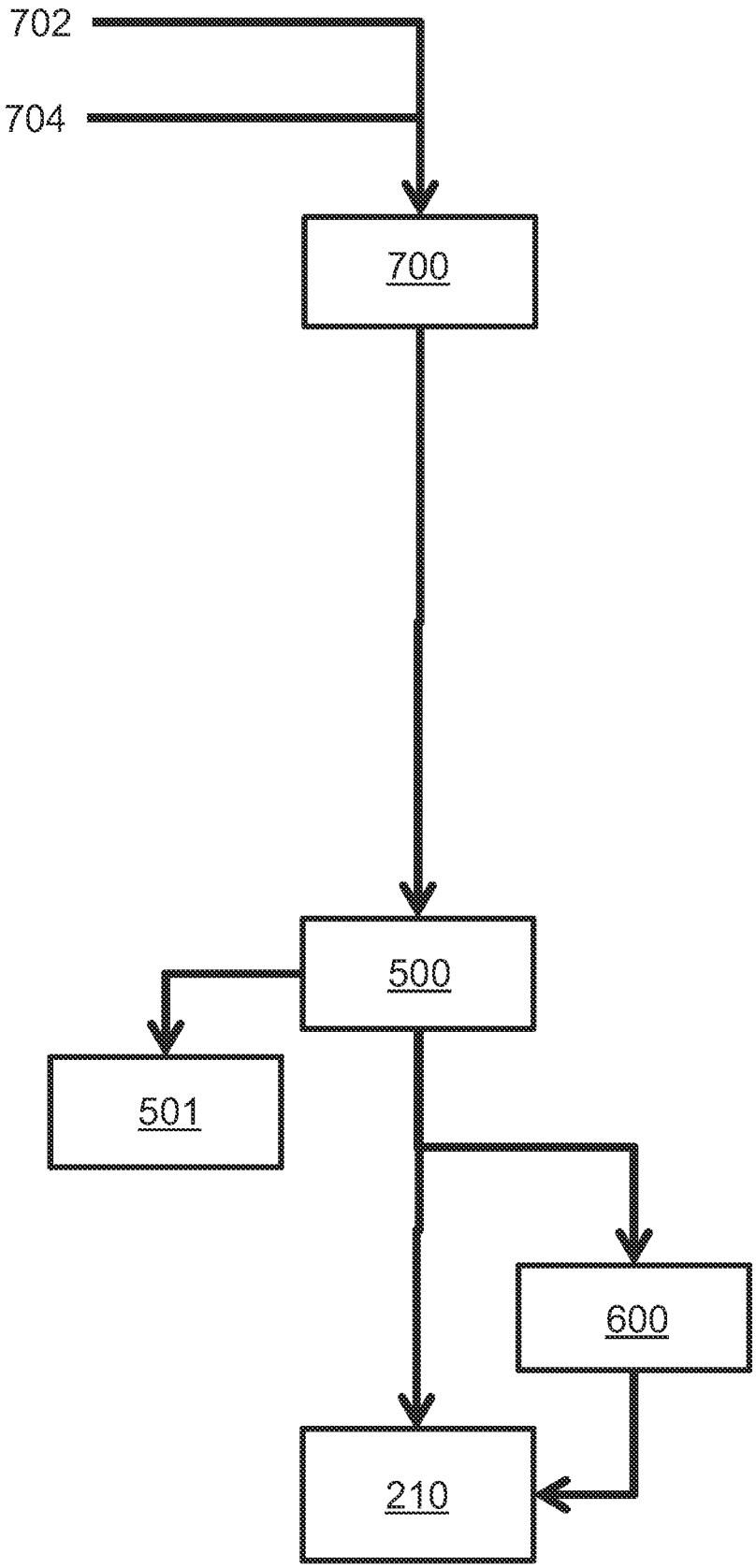
Figure 7I:
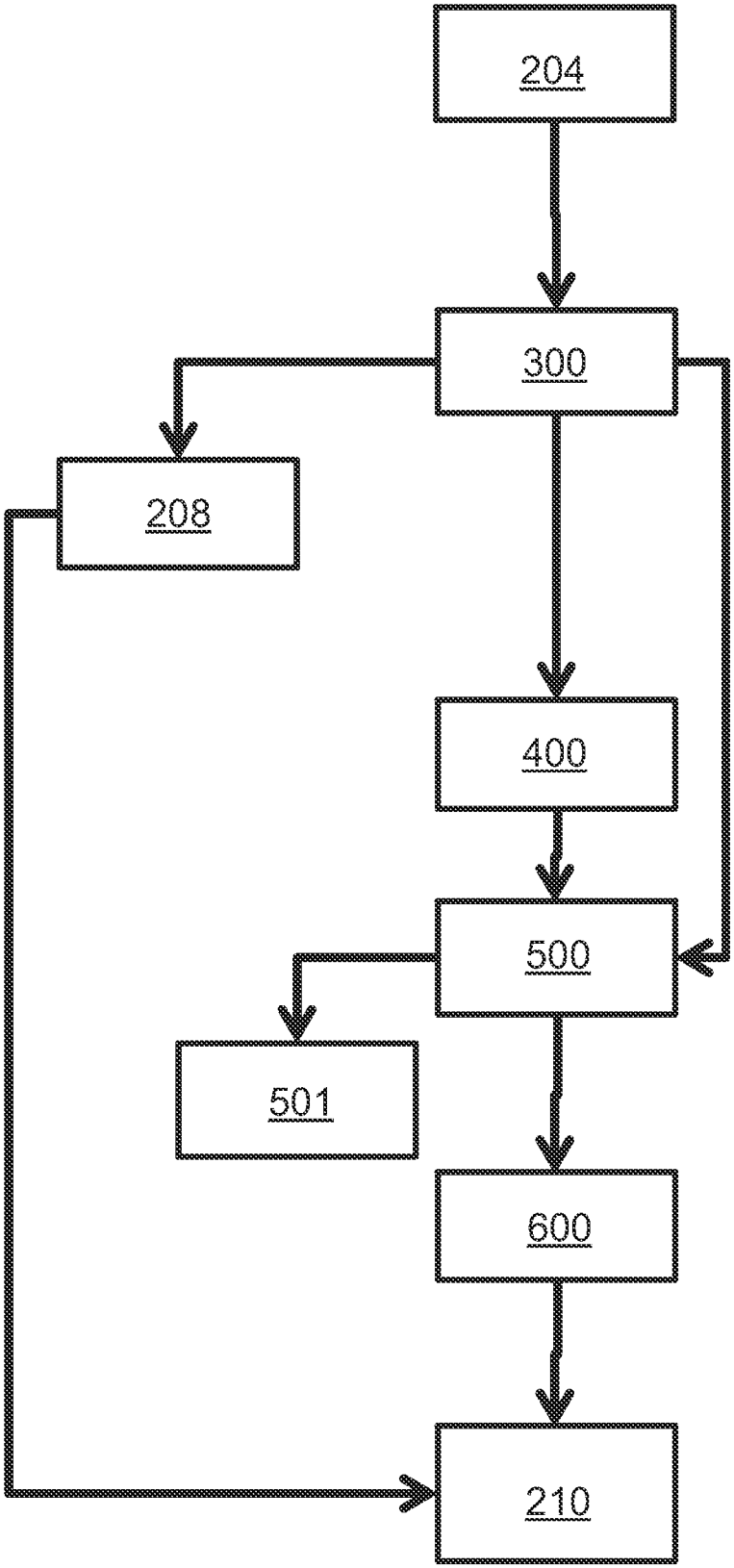

In accordance with the example depicted in FIG. 7*k*, a tray 700 is configured to receive water 702 and a field concentrate 704. The field concentrate 704 was obtained from outdoors during a prospecting session, and now the field concentrate 704 is brought back to an indoor setting (for further processing, in a batch processing session). The output of the tray 700 is in fluid communication with the input of the magnetite-separator assembly 500. The magnetite output of the magnetite-separator assembly 500 is in fluid communication with the magnetite catcher 501. In accordance with a first option, the bypass output of the magnetite-separator assembly 500 is in fluid communication with the input of the sluice assembly 600. The bypass output of the sluice assembly 600 is in fluid communication with the settling pond 210. It is understood that the sluice assembly 600 retains the placer gold. In accordance with a second option, the bypass output of the magnetite-separator assembly 500 is in fluid communication with the settling pond 210.

In accordance with the example depicted in FIG. 7*l*, the output of the grizzly filter section 204 is in fluid communication with the input of the gold-concentrator assembly 300. The first bypass output of the gold-concentrator assembly 300 is in fluid communication with the input of the gold-nugget trap 208 (or with the input of a sluice assembly). The second bypass output of the gold-concentrator assembly 300 is in fluid communication with the magnetite-separator assembly 500. The concentrator output of the gold-concentrator assembly 300 is in fluid communication with the input of the gold-detection assembly 400. The output of the gold-nugget trap 208 is in fluid communication with the settling pond 210. The output of the gold-detection assembly 400 is in fluid communication with the input of the magnetite-separator assembly 500. The magnetite output of the magnetite-separator assembly 500 is in fluid communication with the magnetite catcher 501. The bypass output of the magnetite-separator assembly 500 is in fluid communication with the input of the sluice assembly 600. The bypass output of the sluice assembly 600 is in fluid communication with the settling pond 210. It is understood that the sluice assembly 600 retains the placer gold.

Figure 7M:
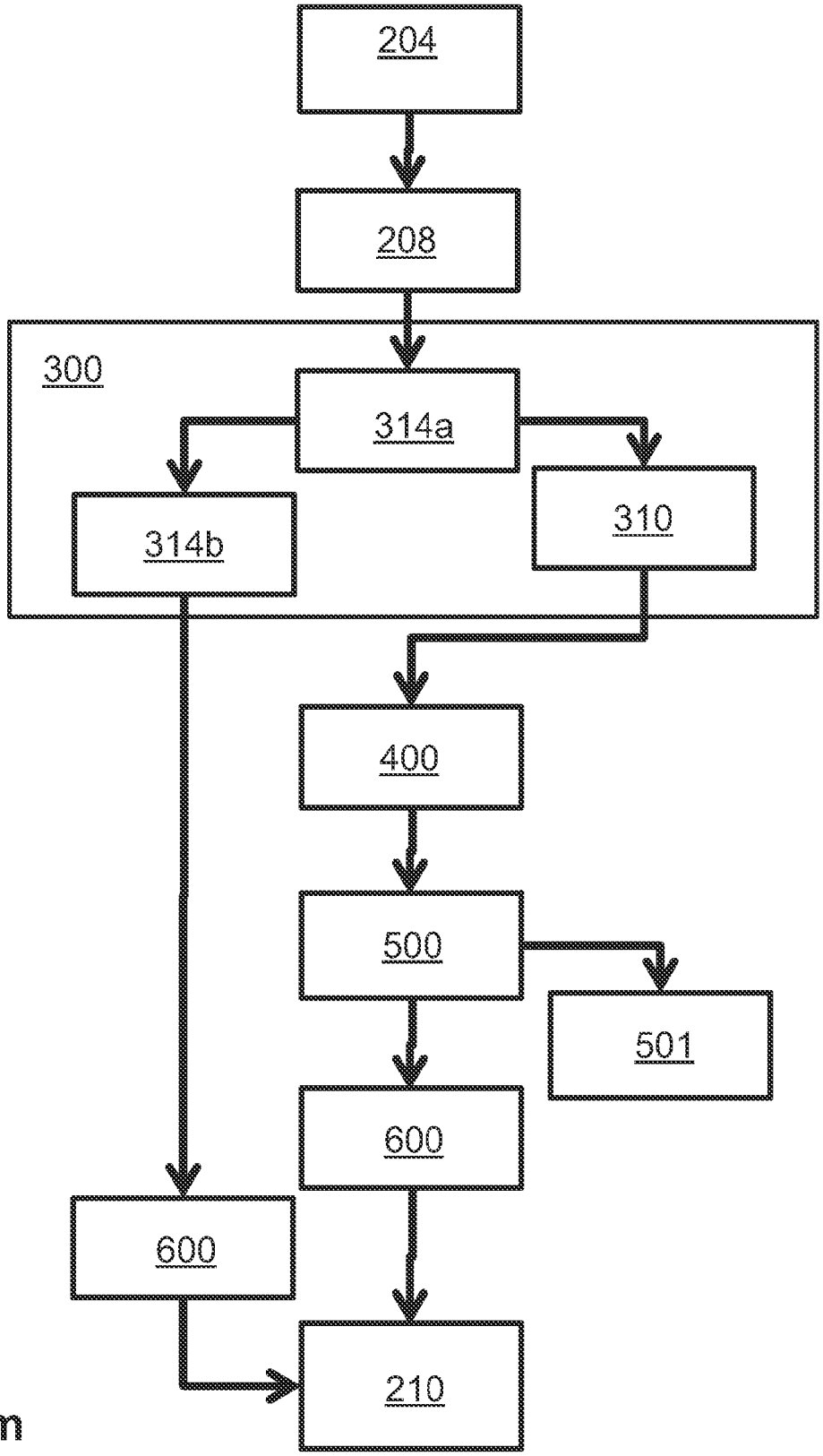

In accordance with the example depicted in FIG. 7*m* (which corresponds to the example of FIG. 3*f*), the output of the grizzly filter section 204 is in fluid communication with the input of the gold-nugget trap 208. The output of the gold-nugget trap 208 is in fluid communication with the input of the gold-concentrator assembly 300. The gold-concentrator assembly 300 includes the fine mesh portion 314*a* and the course mesh portion 314*b* and the self-flushing riffle region 310. The input of the gold-concentrator assembly 300 is in fluid communication with the fine mesh portion 314*a*. The first output of the fine mesh portion 314*a* is in fluid communication with the input of the self-flushing riffle region 310. The output of the self-flushing riffle region 310 is in fluid communication with the input of the gold-detection assembly 400. The bypass output of the fine mesh portion 314*a* is in fluid communication with the input of the course mesh portion 314*b*. The output of the course mesh portion 314*b* is in fluid communication with the input of the sluice assembly 600. The concentrator output of the gold-concentrator assembly 300 (from the self-flushing riffle region 310) is in fluid communication with the gold-detection assembly 400. The output of the gold-detection assembly 400 is in fluid communication with the input of the magnetite-separator assembly 500. The magnetite output of the magnetite-separator assembly 500 is in fluid communication with the magnetite catcher 501. The bypass output of the magnetite-separator assembly 500 is in fluid communication with the input of the sluice assembly 600. The bypass output of the sluice assembly 600 is in fluid communication with the settling pond 210. It is understood that the sluice assembly 600 retains the placer gold.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

It may be appreciated that the assemblies and modules described above may be connected with each other as may be required to perform desired functions and tasks that are within the scope of persons of skill in the art to make such combinations and permutations without having to describe each and every one of them in explicit terms. There is no particular assembly, or components, that are superior to any of the equivalents available to the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for the purposes of this document, that the phrase "includes" is equivalent to the word "comprising." It is noted that the foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a placer-gold processing system, including:

an upstream section being configured to receive gravel and flowing water thereby forming flowing slurry having placer gold;

a gold-concentrator assembly being configured to be in fluid communication with the upstream section;

a gold-detection assembly being configured to be in fluid communication with the gold-concentrator assembly; and a magnetite-separator assembly being configured to be in fluid communication with the gold-concentrator assembly; and wherein the placer-gold processing system further includes:

a self-flushing riffle region, including:

a riffle body defining riffle grooves that are each spaced apart from each other along a length of the riffle body; and the riffle grooves being configured to receive the flowing slurry having the placer gold, and the placer gold falls, via gravity, into the riffle grooves as the placer gold travels along the riffle body, and any of the placer gold, which is not received by the riffle grooves, exits the gold-concentrator assembly via a waste output region; and an output of the riffle grooves are directed to the gold-detection assembly; and wherein the gold-detection assembly includes:

a gold-indicator section including any one of sandpaper, coarse material, textured material, porous material, soft rubber and a sticky material being positioned in the gold-detection assembly in such a way that the gold-indicator section, in use, temporarily retards, at least in part, motion of the placer gold being conveyed by the flowing slurry as the flowing slurry moves past the gold-indicator section, and the placer gold, which was temporarily retarded from motion by the gold-indicator section, is visually displayed to a user; and whereby the gold-detection assembly assists the user to locate the desirable gravel that provides the desirable amount of placer gold by having the user visually monitor the gold-detection assembly for a temporarily retarded amount of the placer gold, and once the amount of placer gold, which is temporarily retarded and visually displayed to the user, is desirable, the user can then focus on the site which provides this condition while avoiding continued prospecting of unproductive sites and thereby avoid wasting time, and the gold-detection assembly provides an opportunity, for the user, to view whether there is any placer gold in each shovel of gravel feed into the upstream section; and wherein the gold-detection assembly includes:

an open container assembly including:

an input section configured to fluidly receive the flowing slurry carrying the placer gold; and an output section in fluid communication with and positioned downstream from the input section, and the output section configured to output the flowing slurry carrying the placer gold received from the input section; and the gold-indicator section is fixedly positioned downstream from the input section and upstream from the output section; and the gold-indicator section is configured to contact, at least in part, the placer gold conveyed by the flowing slurry carrying the placer gold arriving from the input section; and the gold-indicator section is also configured to retard, at least in part, the motion of the placer gold relative to the flowing slurry as the flowing slurry moves toward the output section; and the gold-indicator section is also configured to temporarily hold and retard, at least in part, the motion of the placer gold conveyed by the flowing slurry received, at least in part, from the input section in such a way that some amount of the placer gold is temporarily held by the gold-indicator section as the flowing slurry moves past the gold-indicator section; and the gold-indicator section is also configured to visually display, at least in part, the placer gold that was retarded from motion relative to the flowing slurry as the flowing slurry moves toward the output section; and wherein the magnetite-separator assembly includes:

a disk configured to rotate; and paddles that extend radially from the disk; and the disk and the paddles configured to be driven, operated and rotated by an input of the flowing slurry onto the magnetite-separator assembly; and a magnetite-attraction area including a magnet mounted to the disk; and the magnet configured to attract and retain magnetite that is directed from the gold-detection assembly toward the disk in such a way that the placer gold and fine sand deflects from the disk to a sluice assembly to an output area of the magnetite-separator assembly;

a nozzle oriented toward the disk and the paddles; and the nozzle configured to direct a stream of water, via a water spray, with enough strength that the magnetite that is held by the magnet is knocked off the disk and travels into a magnetite catcher; and as the disk is made to rotate in the flowing slurry, the magnet, in use, removes the magnetite from the flowing slurry, and the nozzle, in use, removes the magnetite from the disk and also urges rotation of the disk.

2. The apparatus of claim 1, wherein:

the gold-concentrator assembly is configured to:

receive, at least in part, the flowing slurry and the placer gold from the upstream section of the placer-gold processing system.

3. The apparatus of claim 2, wherein:

the gold-concentrator assembly is further configured to:

divert, at least in part, the placer gold and the flowing slurry, which was received, away from a waste output region and toward a diverter output region in such a way that at least more of the placer gold travels through the diverter output region than through the waste output region.

4. The apparatus of claim 1, wherein:

the gold-concentrator assembly includes:

a trough assembly including:

an input region being configured to fluidly receive the flowing slurry carrying the placer gold;

a diverter output region being configured to be in fluid communication with and positioned downstream from the input region, and the diverter output region being configured to output, at least in part, the flowing slurry being provided by the input region; and a waste output region being configured to be in fluid communication with and positioned downstream from the input region, and the waste output region being configured to output, at least in part, the flowing slurry being provided by the input region.

5. The apparatus of claim 4, wherein:

the trough assembly further includes:

a self-flushing riffle region being configured to be positioned downstream from the input region and upstream from the waste output region, and the self-flushing riffle region being configured to:

receive, at least in part, the flowing slurry and the placer gold arriving from the input region.

6. The apparatus of claim 5, wherein:

the self-flushing riffle region is further configured to:

divert, at least in part, the placer gold and the flowing slurry received from the input region away from the waste output region and toward the diverter output region in such a way that at least more of the placer gold travels through the diverter output region than through the waste output region.

7. The apparatus of claim 1, wherein:

the gold-detection assembly is configured to:

contact, at least in part, the placer gold conveyed by the flowing slurry received, at least in part, from the upstream section of the placer-gold processing system.

8. The apparatus of claim 1, wherein:

the magnetite-separator assembly is configured to:

receive, at least in part, flowing slurry and magnetite particles arriving from an input area.

9. The apparatus of claim 8, wherein:

the magnetite-separator assembly is further configured to:

divert, at least in part, the magnetite particles received, at least in part, from the upstream section of the placer-gold processing system.

10. The apparatus of claim 1, wherein:

the magnetite-separator assembly includes:

an input area being configured to fluidly receive flowing slurry carrying magnetite particles;

an output area being in fluid communication with and positioned downstream from the input area, and the output area being configured to output the flowing slurry being received from the input area; and a magnetite-attraction area having a magnetite output area, the magnetite-attraction area being positioned downstream from the input area and upstream from the output area, the magnetite-attraction area being configured to:

receive, at least in part, the flowing slurry and the magnetite particles arriving from the input area.

11. The apparatus of claim 10, wherein:

the magnetite-attraction area is further configured to:

divert, at least in part, the magnetite particles that were received away from the output area and toward the magnetite output area in such a way that at least more of the magnetite particles travel toward the magnetite output area than through the output area.

12. The apparatus of claim 11, wherein:

the magnetite-attraction area is further configured to:

magnetically attract, at least in part, the magnetite particles away from the flowing slurry.

13. The apparatus of claim 12, wherein:

the magnetite-attraction area is further configured to:

rotatably move, at least in part, the magnetite particles that were attracted away from the flowing slurry to the magnetite output area.

14. The apparatus of claim 13, wherein:

the magnetite-attraction area is further configured to:

release, at least in part, magnetic attraction of the magnetite particles in response to a stream of water from a nozzle striking the magnetite particles in such a way that the magnetite particles that were released enter the magnetite output area; and be rotated by water and slurry flow.

* * * * *